US010078285B2

(12) United States Patent
Kubo et al.

(10) Patent No.: US 10,078,285 B2
(45) Date of Patent: Sep. 18, 2018

(54) TONER AND METHOD FOR MANUFACTURING TONER

(71) Applicant: CANON KABUSHIKI KAISHA, Tokyo (JP)

(72) Inventors: Haruko Kubo, Fukui (JP); Yuhei Terui, Numazu (JP); Yu Yoshida, Mishima (JP); Hitoshi Itabashi, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 37 days.

(21) Appl. No.: 15/456,989

(22) Filed: Mar. 13, 2017

(65) Prior Publication Data

US 2017/0269496 A1 Sep. 21, 2017

(30) Foreign Application Priority Data

Mar. 18, 2016 (JP) ..... 2016-055223

(51) Int. Cl.
*G03G 9/087* (2006.01)
*G03G 9/09* (2006.01)
*G03G 9/08* (2006.01)

(52) U.S. Cl.
CPC ..... *G03G 9/0918* (2013.01); *G03G 9/0806* (2013.01); *G03G 9/0819* (2013.01); *G03G 9/08711* (2013.01); *G03G 9/08755* (2013.01); *G03G 9/092* (2013.01)

(58) Field of Classification Search
CPC . G03G 9/0918; G03G 9/0926; G03G 9/08795
See application file for complete search history.

(56) References Cited

U.S. PATENT DOCUMENTS

| | | | |
|---|---|---|---|
| 5,494,770 | A | 2/1996 | Baba et al. |
| 5,573,880 | A | 11/1996 | Mayama et al. |
| 5,576,133 | A | 11/1996 | Baba et al. |
| 5,744,278 | A | 4/1998 | Ayaki et al. |
| 5,985,502 | A | 11/1999 | Ayaki et al. |
| 6,083,655 | A | 7/2000 | Itabashi et al. |
| 6,106,990 | A | 8/2000 | Tazawa et al. |
| 6,124,070 | A | 9/2000 | Baba et al. |
| 6,165,663 | A | 12/2000 | Baba et al. |
| 6,500,593 | B2 | 12/2002 | Abe et al. |
| 6,566,028 | B2 | 5/2003 | Tazawa et al. |
| 6,689,525 | B2 | 2/2004 | Itabashi |
| 6,790,576 | B2 | 9/2004 | Fujimoto et al. |
| 6,808,855 | B2 | 10/2004 | Ayaki et al. |
| 7,323,282 | B2 | 1/2008 | Ohno et al. |
| 8,053,156 | B2 | 11/2011 | Abe et al. |
| 8,178,275 | B2 | 5/2012 | Tani et al. |
| 8,383,312 | B2 | 2/2013 | Fujimoto et al. |
| 8,440,382 | B2 | 5/2013 | Isono et al. |
| 8,497,054 | B2 | 7/2013 | Sugiyama et al. |
| 8,574,801 | B2 | 11/2013 | Itabashi et al. |
| 8,609,312 | B2 | 12/2013 | Itabashi et al. |
| 8,652,725 | B2 | 2/2014 | Watanabe et al. |
| 8,652,737 | B2 | 2/2014 | Handa et al. |
| 8,778,581 | B2 | 7/2014 | Nonaka et al. |
| 8,828,633 | B2 | 9/2014 | Itabashi et al. |
| 8,883,946 | B2 | 11/2014 | Yasumatsu et al. |
| 8,916,319 | B2 | 12/2014 | Ikeda et al. |
| 8,940,467 | B2 | 1/2015 | Hashimoto et al. |
| 8,975,000 | B2 | 3/2015 | Tani et al. |
| 9,029,056 | B2 | 5/2015 | Kenmoku et al. |
| 9,079,989 | B2 | 7/2015 | Yasumatsu et al. |
| 9,098,002 | B2 | 8/2015 | Kenmoku et al. |
| 9,098,003 | B2 | 8/2015 | Masumoto et al. |
| 9,158,216 | B2 | 10/2015 | Shimano et al. |
| 9,229,345 | B2 | 1/2016 | Ikeda et al. |
| 9,377,705 | B2 | 6/2016 | Shimano et al. |
| 9,383,668 | B2 | 7/2016 | Noji et al. |
| 9,575,424 | B2 | 2/2017 | Nakagawa et al. |
| 9,599,919 | B2 | 3/2017 | Isono et al. |
| 9,632,441 | B2 | 4/2017 | Abe et al. |
| 2012/0172562 | A1 | 7/2012 | Kenmoku et al. |
| 2013/0065174 | A1 | 3/2013 | Itabashi et al. |
| 2015/0099220 | A1 | 4/2015 | Abe et al. |
| 2015/0099222 | A1 | 4/2015 | Terui et al. |
| 2015/0153669 | A1 | 6/2015 | Yoshida et al. |
| 2015/0286157 | A1* | 10/2015 | Masumoto ..... G03G 9/081 430/108.4 |
| 2015/0370189 | A1 | 12/2015 | Tanaka et al. |
| 2016/0246192 | A1 | 8/2016 | Yoshida et al. |
| 2016/0349646 | A1 | 12/2016 | Yoshida et al. |
| 2017/0052465 | A1 | 2/2017 | Shimano et al. |

FOREIGN PATENT DOCUMENTS

| | | |
|---|---|---|
| JP | S63-248864 | 10/1988 |
| JP | S63-270060 | 11/1988 |

(Continued)

OTHER PUBLICATIONS

Translatino of JP 06/214426.*

*Primary Examiner* — Peter L Vajda

(74) *Attorney, Agent, or Firm* — Fitzpatrick Cella Harper and Scinto

(57) ABSTRACT

Provided is a toner comprising a toner particle containing: a binder resin; a pigment; a resin having an acidic functional group; and a fixing auxiliary agent, wherein the pigment is a pigment having a structure derived from a basic compound, and the binder resin and the fixing auxiliary agent satisfy following Formula (1):

$$(TgA-TgB)\geq 5.0^\circ\ \mathrm{C.} \qquad \text{Formula (1)}$$

and given HP1 as a hydrophobic parameter of the resin having an acidic functional group and HP2 as a hydrophobic parameter of the fixing auxiliary agent, the HP1 is at least 0.60, and following Formula (2) is satisfied:

$$|HP1-HP2|\leq 0.30 \qquad \text{Formula (2).}$$

20 Claims, No Drawings

(56) References Cited

FOREIGN PATENT DOCUMENTS

| | | | | |
|---|---|---|---|---|
| JP | 06-214426 | * | 8/1994 | ..... G03G 9/09 |
| JP | 2004-045654 | | 2/2004 | |
| JP | 2005-181835 | | 7/2005 | |
| JP | 2005215501 | A | 8/2005 | |
| JP | 2007131832 | A | 5/2007 | |
| JP | 4097312 | B2 | 6/2008 | |
| JP | 4361676 | B2 | 11/2009 | |
| JP | 4484171 | | 6/2010 | |
| JP | 2012133192 | A | 7/2012 | |
| JP | 2012-256044 | | 12/2012 | |
| JP | 2012256044 | A | 12/2012 | |
| JP | 2014-222356 | | 11/2014 | |
| JP | 2015125406 | A | 7/2015 | |
| JP | 2015-148731 | | 8/2015 | |

* cited by examiner

TONER AND METHOD FOR MANUFACTURING TONER

BACKGROUND OF THE INVENTION

Field of the Invention

The present invention relates to a toner for use in image-forming methods such as electrophotographic methods, electrostatic recording methods and toner jet methods, and to a method for manufacturing a toner.

Description of the Related Art

In recent years, developers of electrophotographic techniques used in printers, copiers and the like are facing demands for lighter, smaller and more energy-efficient devices. To fulfill these demands, toners need to have improved tinting strength and low-temperature fixability.

An effective means of increasing the tinting strength of a toner is to finely disperse the pigment. Pigment dispersants are being developed and modifications to the pigment itself are being investigated in an effort to improve pigment dispersibility. Japanese Patent Application Publication No. S63-248864 proposes a pigment dispersant using a derivative obtained by modifying a pigment. Japanese Patent Application Publication No. 2005-181835 proposes a pigment dispersant that exploits acid-base interactions between the pigment and the pigment dispersant.

Toner fixability is also being improved in an effort to save energy. Japanese Patent Application Publication No. 2015-148731 proposes a novel crystalline resin containing sulfonic acid groups, aimed at achieving both low-temperature fixability and heat-resistant storability of the toner.

SUMMARY OF THE INVENTION

However, satisfactory pigment dispersibility has not always been achieved by partially modifying the pigment as described in Japanese Patent Application Publication No. S63-248864. With the pigment dispersant described in Japanese Patent Application Publication No. 2005-181835, pigment dispersibility is improved, but is still not entirely satisfactory. In general, many existing pigment dispersants using acid-base interactions have high acid values or amine values in order to increase interactivity with the pigment. The polarity of the pigment dispersion in the toner particle is likely to be high as a result, and pigment dispersibility may be reduced due to self-aggregation of the dispersion or interactions with other materials in the toner.

On the other hand, although the crystalline resin described in Japanese Patent Application Publication No. 2015-148731 improves low-temperature fixability and heat-resistant storability, satisfactory results have not always been obtained when it is has been used in combination with a pigment dispersant using acid-base interactions. This is thought to be because components with very different polarities are likely phase separate from each other within the toner particle, and form their own aggregations. This may mean that the resin has insufficient effect on low-temperature fixability, or may lead to fusion between toner particles, detracting from the heat-resistant storability.

It is an object of the present invention to provide a toner that solves these conventional problems, along with a method for manufacturing a toner. That is, it is an aim of the present invention to provide a toner having improved tinting strength due to increased pigment dispersibility, as well as excellent low-temperature fixability and heat-resistant storability, as well as a method for manufacturing a toner therefor.

The inventors discovered as a result of earnest researched aimed at solving these problems that these effects could be achieving with a toner containing a pigment having a structure derived from a basic compound, a resin (hereunder sometimes called a pigment dispersant) having an acidic functional group, and a fixing auxiliary agent.

The present invention is a toner comprising a toner particle containing a binder resin, a pigment, a resin having an acidic functional group, and a fixing auxiliary agent, wherein the pigment is a pigment having a structure derived from a basic compound;

the binder resin and the fixing auxiliary agent satisfy following Formula (1):

$$(TgA-TgB)\geq 5.0^\circ\ \mathrm{C.} \qquad \text{Formula (1)}$$

where

TgA represents a glass transition temperature (Tg) in differential scanning colorimetry of the binder resin, and TgB represents a Tg in differential scanning colorimetry of a resin mixture obtained by mixing the binder resin and the fixing auxiliary agent at a mass ratio of 9:1; and the resin having an acidic functional group has a hydrophobic parameter HP1 of at least 0.60, the fixing auxiliary agent has a hydrophobic parameter HP2, and the HP1 and the HP2 satisfy following Formula (2):

$$|HP1-HP2|\leq 0.30 \qquad \text{Formula (2)}$$

where HP1 represents a volume fraction of heptane at a point of precipitation by the resin having an acidic functional group as measured by the addition of heptane to a solution containing 0.01 mass parts of the resin having an acidic functional group and 1.48 mass parts of chloroform, and HP2 represents a volume fraction of heptane at a point of precipitation by the fixing auxiliary agent as measured by the addition of heptane to a solution containing 0.01 mass parts of the fixing auxiliary agent and 1.48 mass parts of chloroform.

The present invention is also a toner comprising a toner particle containing a binder resin, a pigment, and a resin having an acidic functional group, wherein the toner particle further contains at least one of a crystalline polyester and a wax, the wax is at least one of an ester compound of a monohydric or polyhydric alcohol with an aliphatic monocarboxylic acid and an ester compound of a monovalent or polyvalent carboxylic acid with an aliphatic monoalcohol, the pigment is a pigment having a structure derived from a basic compound, and the resin having an acidic functional group has a hydrophobic parameter HP1 of at least 0.60, the crystalline polyester or wax has a hydrophobic parameter HP2, and the HP1 and the HP2 satisfy following Formula (2):

$$|HP1-HP2|\leq 0.30 \qquad \text{Formula (2)}$$

where HP1 represents a volume fraction of heptane at a point of precipitation by the resin having an acidic functional group as measured by the addition of heptane to a solution containing 0.01 mass parts of the resin having an acidic functional group and 1.48 mass parts of chloroform, and HP2 represents a volume fraction of heptane at a point of precipitation by the crystalline polyester or wax as measured by the addition of heptane to a solution containing 0.01 mass parts of the crystalline polyester or wax and 1.48 mass parts of chloroform.

The present invention also relates to a method for manufacturing the toner, wherein the manufacturing method comprises either a step (i) or a step (ii) below:

(i) a step of granulating, in an aqueous medium, a polymerizable monomer composition containing a polymerizable monomer capable of forming the binder resin, the resin having an acidic functional group, the pigment, and the fixing auxiliary agent, and then polymerizing the polymerizable monomer contained in the polymerizable monomer composition, to thereby manufacture a toner particle;

(ii) a step of granulating, in an aqueous medium, an organic solvent dispersion containing the binder resin, the pigment, the resin having an acidic functional group and the fixing auxiliary agent in an organic solvent, to thereby manufacture a toner particle.

Provided is a toner having enhanced tinting strength because pigment dispersibility is improved in comparison with conventional toners, and also having excellent low-temperature fixability and heat-resistant storability, together with method for manufacturing a toner.

Further features of the present invention will become apparent from the following description of exemplary embodiments (with reference to the attached drawings).

DESCRIPTION OF THE EMBODIMENTS

Embodiments of the present invention are explained in detail below, but the present invention is not limited to these embodiments.

Unless otherwise specified, numerical ranges such as "at least A and not more than B" or "A to B" in the present invention include the minimum and maximum values at either end of the range.

For the purpose of improving pigment dispersibility, the toner of the present invention contains a pigment having a structure derived from a basic compound and a resin having an acidic functional group (hereunder sometimes called a pigment dispersant). It also contains a hydrophobic fixing auxiliary agent for the purpose of improving low-temperature fixability. The mechanism by which the effects of the present invention are achieved is thought to be as follows.

In the present invention, it is thought that pigment dispersibility is improved and tinting strength enhanced by means of acid-base interactions between the acidic pigment dispersant and the basic pigment. Because the pigment dispersant in the present invention has an acidic function group and a high degree of hydrophobicity, it can cover the surface of the pigment with hydrophobic groups, thereby suppressing pigment aggregation.

Because the surface of the pigment is highly hydrophobic, moreover, it blends easily with the fixing auxiliary agent when a fixing auxiliary agent is included, and part of the fixing auxiliary agent remains on the surface of the pigment. Viscoelasticity is thereby reduced at the boundary between the pigment and the resin at the instant when heat is applied during fixing, and it is thought that this positively affects the sharp melt property of the toner and produces the desired effects.

The pigment having a structure derived from a basic compound in the present invention (hereunder sometimes called the "basic-treated pigment" or "treated pigment") is explained first. The basic-treated pigment is a pigment containing an organic dye (sometimes called a "treatment agent") having basic segments, or a pigment having a basic functional group.

A pigment containing an organic dye (treatment agent) having basic segments can be obtained for example by mixing an organic dye (treatment agent) having basic segments with a pigment. A pigment having a basic functional group can be obtained for example by direct chemical modification of the pigment with a basic compound to partially basify the pigment. Either embodiment of the basic-treated pigment is possible, but a pigment containing an organic dye (treatment agent) having basic segments is preferred for ease of adjusting the base value of the pigment and ease of development into pigment types.

The organic dye (treatment agent) having basic segments in the present invention is preferably a structure represented by Formula (3) below, comprising a basic compound derived from an amino group, bound to an organic dye via an alkylene group.

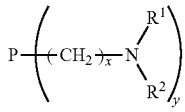

(3)

(In Formula (3), P is an organic dye, x is 1 or 2, y is a value of at least 1 and not more than 4, and each of $R^1$ and $R^2$ independently represents a hydrogen atom or linear or branched alkyl group, or a group needed for forming a (preferably $C_{3-6}$) heterocycle in which $R^1$ and $R^2$ bind together.)

P is an organic dye, and is preferably a structure adsorbable by the pigment. More preferably, P is an organic dye having a phthalocyanine skeleton or a quinacridone skeleton. Specific examples include copper phthalocyanine, zinc phthalocyanine, 2,9-dimethylquinacridone, unsubstituted quinacridone and the like.

y represents the average number of basic segments bound to the organic dye (average per molecule of organic dye), and is at least 1 and not more than 4 (preferably at least 2 and not more than 4). A value within this range is desirable for improving the adsorption rate to the resin having an acidic functional group.

A structure in which each of $R^1$ and $R^2$ is independently a hydrogen atom or $C_{1-4}$ linear or branched alkyl group, or $R^1$ and $R^2$ bind together to form a heterocycle, is desirable for controlling steric hindrance and facilitating adsorption to the resin having an acidic functional group. When $R^1$ and $R^2$ bind together to form a heterocycle, a nitrogen atom or oxygen atom may be included in the ring structure in addition to the N in Formula (3).

Specific examples of basic functional groups corresponding to —$NR^1R^2$ in Formula (3) above include an amino group as a primary amine, monomethylamino, monoethylamino, monopropylamino, monoisopropylamino, monobutylamino, monoisobutylamino, mono-tert-butylamino, monopentylamino and monohexylamino groups as secondary amines, and dimethylamino, diethylamino, dipropylamino, diisopropylamino, dibutylamino, diisobutylamino, di-tert-butylamino, dipentylamino, dihexylamino, methylethylamino, methylpropylamino, methylbutylamino, ethylpropylamino, ethylbutylamino, pyrrolidinyl, piperidinyl, piperadinyl, morpholino, pyrrolyl and phthalimido groups as tertiary amines.

The method of manufacturing the organic dye having basic segments is not particularly limited, and it can be manufactured by a conventional known method. Specifically, the manufacturing method described in Japanese Patent No. 4484171 can be used.

A basic-treated pigment obtained by mixing the treatment agent of Formula (3) with a pigment preferably has a base dissociation constant (pKa) of at least 4.0 and not more than 7.0 in order to improve adsorbability to the resin having an acidic functional group.

The pKa is measured by preparing a pigment dispersion in which 10.0 mass parts of the pigment, 140.0 mass parts of toluene and 60.0 mass parts of ethanol are mixed, and carrying out neutralization titration with a 0.1 mol/L hydrochloric acid ethanol solution. The pKa measurement method is described below. The pKa of the basic-treated pigment can be easily maintained in the range of at least 4.0 and not more than 7.0 if $—NR^1R^2$ in Formula (3) is a tertiary amine. A pKa of at least 4.5 and not more than 6.5 is more preferred for suppressing the polarity of the basic-treated pigment and facilitating adsorption of the resin having an acidic functional group.

A treatment agent that can be used in the basic-treated pigment preferably has a structure represented by Formula (3), in which the basic functional group corresponding to $—NR^1R^2$ has either a $C_{1-4}$ dialkylamine structure or $C_{3-6}$ cyclic amine structure. This serves to keep the pKa of the basic-treated pigment within the desired range, and makes it less likely that adsorption of the resin having an acidic functional group will be blocked by steric hindrance, thus improving pigment dispersibility within the toner particle so that tinting strength can be easily improved.

As discussed above, the pigment having a structure derived from a basic compound may also be a pigment having a basic functional group. The basic functional group is preferably a group represented by Formula (3-1) below.

(3-1)

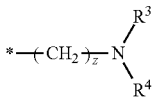

In Formula (3-1), * represents a segment binding to the pigment, z is 1 or 2, and each of $R^3$ and $R^4$ independently represents a hydrogen atom or linear or branched alkyl group, or a group needed for forming a (preferably $C_{3-6}$) heterocycle in which $R^3$ and $R^4$ bind together.

Preferred embodiments of $R^3$ and $R^4$ are similar to those given for $R^1$ and $R^2$ above. Embodiments of the group corresponding to $—NR^3R^4$ are also similar to those given for the functional group corresponding to $—NR^1R^2$. The pigment having a basic functional group can be obtained for example by direct chemical modification of the pigment with a basic compound to partially basify the pigment. As a specific method, a pigment and a basic compound having a basic functional group can be reacted together in concentrated sulfuric acid.

In the present invention, the content of the pigment having a structure derived from a basic compound is preferably at least 4 and not more than 20 mass parts per 100 mass parts of the binder resin.

The pigment having a structure derived from a basic compound is preferably a pigment containing an organic dye (treatment agent) having basic segments. Pigments that can be used to obtain the basic-treated pigment include the conventional known pigments listed below.

Examples of black pigments include carbon black.

Examples of yellow pigments include condensation pigments, isoindolinone compounds, anthraquinone compounds, azo metal complex methine compounds, allylamide compounds and the like. More specific examples include C.I. Pigment Yellow 3, 7, 10, 12, 13, 14, 15, 17, 23, 24, 60, 62, 74, 75, 83, 93, 94, 95, 99, 100, 101, 104, 108, 109, 110, 111, 117, 123, 128, 129, 138, 139, 147, 148, 150, 155, 166, 168, 169, 177, 179, 180, 181, 183, 185, 191:1, 191, 192, 193 and 199.

Examples of magenta pigments include condensation pigments, diketopyrrolopyrrole compounds, anthraquinone compounds, quinacridone compounds, basic dye lake compounds, naphthol compounds, benzimidazolone compounds, thioindigo compounds and peryline compounds. More specific examples include C.I. Pigment Red 2, 3, 5, 6, 7, 23, 48:2, 48:3, 48:4, 57:1, 81:1, 122, 146, 150, 166, 169, 177, 184, 185, 202, 206, 220, 221, 238, 254, 269, and C.I. Pigment Violet 19 and the like.

Examples of cyan pigments include phthalocyanine compounds, derivatives of phthalocyanine compounds, anthraquinone compounds, basic dye lake compounds and the like. More specific examples include C.I. Pigment Blue 1, 7, 15, 15:1, 15:2, 15:3, 15:4, 60, 62 and 66.

One of these pigments or a combination of two or more may be mixed with the treatment agent. Moreover, these pigments may be directly chemically modified to partially basify the pigment and obtain a basic-treated pigment.

In the present invention, the base value of the pigment (basic-treated pigment) is preferably at least 0.9 mg KOH/g and not more than 3.0 mg KOH/g, or more preferably at least 1.3 mg KOH/g and not more than 2.5 mg KOH/g. If the base value is at least 0.9 mg KOH/g, pigment dispersibility is improved and tinting strength is more easily improved because the quantity of the treatment agent is sufficient. If it is not more than 3.0 mg KOH/g, on the other hand, adequate tinting strength can be obtained without adversely affecting the other toner characteristics. The base value of the basic-treated pigment can be controlled by adjusting the mixed amounts of the pigment and treatment agent. The method of measuring base value is described below.

The resin having an acidic functional group (pigment dispersant) in the present invention is explained next. The resin having an acidic functional group is characterized by a hydrophobic parameter HP1 of at least 0.60. If the HP1 is at least 0.60, the hydrophobicity of the pigment surface is increased, thereby increasing its affinity for the binder resin and making it easier to suppress pigment aggregation within the toner particle. An HP1 of at least 0.75 is preferred not only for suppressing pigment aggregation but also for improving compatibility with the fixing auxiliary agent so that satisfactory tinting strength, low-temperature fixability and heat-resistant storability can all be achieved simultaneously. There is no particular upper limit, but preferably the HP1 is not more than 0.95, or more preferably not more than 0.90. The HP1 can be controlled by changing the composition of the resin having an acidic functional group.

The HP1 is the volume fraction of heptane at the point of precipitation by the resin having an acidic functional group as measured by the addition of heptane to a solution containing 0.01 mass parts of the resin having an acidic functional group and 1.48 mass parts of chloroform.

The acidic functional group is preferably a carboxy group, sulfo group, phosphoric acid group, phenolic hydroxy group or the like. Of these acidic functional groups, a carboxyl, sulfo or phosphoric acid group is preferred because it is highly acidic, and a carboxy or sulfo group is more preferred from the standpoint of ease of manufacture and stability of the resin. When a carboxy group or sulfo group is used as the acidic functional group, tinting strength can also be improved because interactions with the treated pigment are stronger.

The acidic functional group of the resin having an acidic functional group in the present invention preferably has a structure represented by Formula (4) below.

(4)

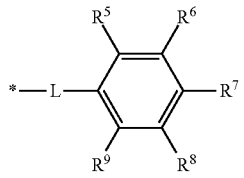

In Formula 4, one of $R^6$ and $R^7$ is a carboxy group, while each of the $R^5$, $R^6$, $R^7$, $R^8$ and $R^9$ other than the carboxy group is independently a hydrogen atom, hydroxy group, amino group, $C_{1-8}$ alkyl group or $C_{1-8}$ alkoxy group, L is a linking group represented by Formula (5) below, and * is a segment binding to the main chain skeleton of the resin having an acidic functional group.

(5)

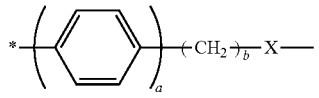

In Formula (5), a is 0 or 1, b is an integer of at least 0 and not more than 4, X is a single bond or a group represented by —O—, —S— or —$NR^{10}$—, $R^{10}$ is a hydrogen atom or $C_{1-4}$ alkyl group, and * is a segment binding to the main chain skeleton of the resin having an acidic functional group.

The carboxy group in Formula (4) is a segment that is adsorbed to the basic-treated pigment. When the acidic functional group is a carboxy group, the acidity is weaker than when it is a sulfo group. In this case, although the acidity is weaker, adsorbability to the pigment is maintained because the pKa of the basic-treated pigment is close to neutral, and thus tinting strength can be maintained. The low acidity is also desirable because it makes it easier to reduce interactions with polar constituents other than the treated pigment in the toner particle, decreasing the risk of adverse effects on the toner characteristics.

This carboxy group is preferably either $R^6$ or $R^7$ in Formula (4). This is because these are located further from the polymer main chain, and therefore create less steric hindrance when the resin is adsorbed to the pigment, so that adsorbability is more easily improved. When a functional group other than a carboxy group is included, it is preferably a $C_{1-4}$ alkyl group or $C_{1-4}$ alkoxy group from the standpoint of steric hindrance during adsorption.

The a in Formula (5) is more preferably 1. When a is 1, adsorbability to the pigment can be easily improved because the distance between the adsorbed segment and the polymer main chain can be controlled at a suitable distance. For similar reasons, b is preferably at least 1 and not more than 4. When X is —O—, interactions involving hydrogen bonds are likely to operate in addition to the acid-base interactions of the carboxy groups, which is desirable for improving adsorbability.

The structure represented by Formula (4) is preferably a structure represented by Formula (6) below.

(6)

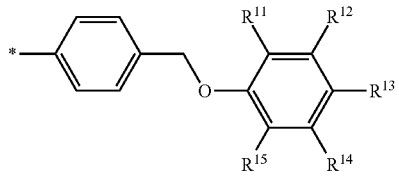

In Formula (6) one of $R^{12}$ and $R^{13}$ is a carboxy group, and the other is a hydroxy group, each of $R^{11}$, $R^{14}$ and $R^{15}$ is independently a hydrogen atom, hydroxyl group, amino group, $C_{1-4}$ alkyl group or $C_{1-4}$ alkoxy group, and * is a segment binding to the main chain skeleton of the resin having an acidic functional group.

The resin having an acidic functional group preferably has a structure represented by Formula (4) (preferably Formula (6)) in a side chain. When the structure represented by Formula (4) is a structure represented by Formula (6), adsorbability to the treated pigment is likely to be improved and satisfactory tinting strength is easily obtained for the reasons given above.

The main chain skeleton of the resin having an acidic functional group may be any kind of polymer. Examples include vinyl polymers, polyester polymers, polyamide polymers, polyurethane polymers and polyether polymers. Of these, a vinyl polymer or polyester polymer is preferred from the standpoint of ease of manufacture.

A vinyl polymer is more preferred from the standpoint of ease of hydrophobic parameter control. When a vinyl polymer is used as the pigment dispersant, it is possible to use a compound having an introduced polymerizable functional group represented by Formula (7) below. A resin having an acidic functional group can be obtained by copolymerizing a monomer represented by Formula (7) with a vinyl monomer. Alternatively, a resin having an acidic functional group can be obtained by first copolymerizing the monomers of the main chain to obtain a polymer, and then introducing the acidic functional group into this polymer.

(7)

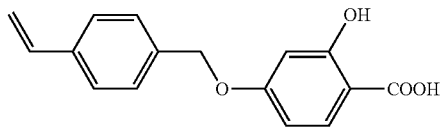

When a vinyl polymer is used as the resin having an acidic functional group, for example the structure represented by Formula (4) is preferably represented by the following Formula (7-1) for example.

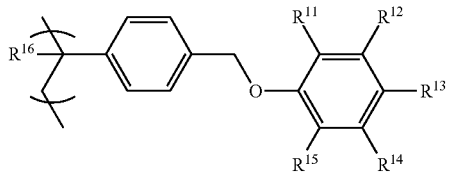

(7-1)

In Formula (7-1) above, $R^{14}$ to $R^{15}$ are as described above, and $R^{16}$ is a hydrogen atom or methyl group.

The vinyl monomer used in the resin having an acidic functional group is not particularly limited. The following vinyl polymers may be used as monomers in the main chain skeleton of the resin having an acidic functional group:

aromatic vinyl monomers such as styrene, o-methylstyrene, m-methylstyrene, p-methylstyrene and α-methylstyrene; ethylene unsaturated monoolefin monomers such as ethylene, propylene, butylene and isobutylene; halogenated vinyl monomers such as vinyl chloride, vinylidene chloride, vinyl bromide and vinyl fluoride; vinyl ester acid monomers such as vinyl acetate, vinyl propionate and vinyl benzoate; acrylic acid monomers such as acrylic acid, methyl acrylate, ethyl acrylate, propyl acrylate, butyl acrylate, 2-ethylhexyl acrylate, octyl acrylate, dodecyl acrylate, stearyl acrylate, behenyl acrylate, hydroxyethyl acrylate, hydroxypropyl acrylate, glycidyl acrylate and benzyl acrylate; and methacrylic acid monomers such as methacrylic acid, methyl methacrylate, ethyl methacrylate, propyl methacrylate, butyl methacrylate, 2-ethylhexyl methacrylate, octyl methacrylate, dodecyl methacrylate, stearyl methacrylate, behenyl methacrylate, hydroxyethyl methacrylate, hydroxypropyl methacrylate, glycidyl methacrylate and benzyl methacrylate. One of these monomers may be used alone, or two or more may be combined.

For purposes of controlling the hydrophobic parameter HP1, The resin having an acidic functional group preferably contains a structure of an alkoxycarbonyl group represented by Formula (8) below.

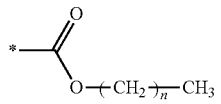

(8)

In Formula (8), n is an integer that is at least 3 and not more than 21, and * is a segment binding to the main chain skeleton of the resin having an acidic functional group.

If n in Formula (8) is at least 3, the hydrophobic parameter HP1 of the resin having an acidic functional group is easier to control. If it is not more than 21, adsorption between the acidic functional group represented by Formula (4) and the treated pigment is not inhibited. The value of HP1 can be controlled by changing the value of n in Formula (8) or the percentage content of the structure represented by Formula (8) per molecule of the resin having an acidic functional group. The resin having an acidic functional group preferably has an alkoxycarbonyl group represented by Formula (8) in a side chain.

A $C_{3-21}$ alkyl ester of acrylic acid or methacrylic acid is preferred as a monomer containing such an alkoxycarbonyl group from which the structure of Formula (8) is derived. Examples include butyl acrylate, stearyl acrylate, behenyl acrylate, butyl methacrylate, stearyl methacrylate and behenyl methacrylate. The content of monomer units containing the structure of Formula (8) is preferably at least 4 mol % and not more than 12 mol % as a percentage of the total monomer units of the resin having an acidic functional group.

The acid value of the resin having an acidic functional group is preferably at least 3.0 mg KOH/g and not more than 25.0 mg KOH/g, or more preferably at least 7.0 mg KOH/g and not more than 20.0 mg KOH/g. If the acid value is at least 3.0 mg KOH/g, the tinting strength can be easily improved because there are more points of adsorption by the treated pigment. If the acid value is not more than 25.0 mg KOH/g, the hydrophobicity of the resin having an acidic functional group can be maintained at a high level, resulting in improved tinting strength as well as greater low-temperature fixability and heat-resistant storability. The acid value of the resin having an acidic functional group can be controlled by altering the composition and molecular weight.

The weight-average molecular weight (Mw) of the resin having an acidic functional group is preferably at least 10,000 and not more than 75,000, or more preferably at least 10,000 and not more than 50,000. If the Mw is at least 10,000, the excluded volume effect acts to provide satisfactory pigment dispersibility, and tinting strength is easily improved. If the Mw is not more than 75,000, tinting strength is easily improved because adsorbability to the treated pigment is maintained. The Mw of the resin having an acidic functional group can be controlled by altering the reaction temperature, reaction time, percentage content of the monomers and amount of the initiator and the like during polymerization.

The content of the resin having an acidic functional group is preferably at least 3.0 mass parts and not more than 30.0 mass parts, or more preferably at least 5.0 mass parts and not more than 25.0 mass parts per 100 mass parts of the pigment (basic-treated pigment). If the content is at least 3.0 mass parts, tinting strength is easily improved because a sufficient amount of the resin having an acidic functional group (pigment dispersant) can be adsorbed to the pigment. If it is not more than 30.0, a rise in polarity within the toner particle can be prevented because there is less excess dispersant that is not adsorbed by the pigment. Pigment aggregation is thus prevented within the toner particle, making it easier to improve tinting strength, low-temperature fixability and heat-resistant stability.

The fixing auxiliary agent used in the present invention is explained next. The fixing auxiliary agent in the present invention is a substance that compatibilizes with the binder resin during heating, producing a plasticizing effect.

The fixing auxiliary agent in the present invention preferably has a melting point of at least 55° C. and not more than 100° C., or more preferably at least 65° C. and not more than 85° C. When the melting point is at least 55° C., heat-resistant storability is easily improved because the fixing auxiliary agent is less likely to melt during high-temperature storage. If the melting point is not more than 100° C., low-temperature fixability is easy to achieve because the fixing auxiliary agent melts even when the fixing temperature is low. The melting point of the fixing auxiliary agent can be controlled by changing the composition of the fixing auxiliary agent.

The fixing auxiliary agent may be any that satisfies Formula (1) below, but a crystalline material is preferred for achieving both low-temperature fixability and heat-resistant storability.

$$(TgA-TgB) \geq 5.0° \text{ C.} \qquad \text{Formula (1)}$$

In Formula (1), TgA is the glass transition temperature (Tg) in differential scanning calorimetry of the binder resin, and TgB is the glass transition temperature (Tg) in differential scanning calorimetry of a resin mixture obtained by mixing the binder resin and the fixing auxiliary agent in a mass ratio of 9:1.

(TgA−TgB) is preferably at least 7.0° C. There is no particular upper limit, but preferably it is not more than 25° C.

The TgA can be controlled by controlling the composition and molecular weight of the binder resin. The TgB can be controlled by controlling the composition and molecular weight of the fixing auxiliary agent.

Examples of crystalline materials include crystalline resins such as crystalline polyester, waxes and the like. At least one of a crystalline polyester and a wax is preferred. A crystalline resin in the present invention is a resin is one that exhibits an endothermic peak in differential scanning calorimetry (DSC).

The crystalline polyester is preferably a condensation polymer of a diol and a dicarboxylic acid.

Examples of dicarboxylic acids include alkanedicarboxylic acids (for example, succinic acid, adipic acid, pimelic acid, suberic acid, azelaic acid, sebacic acid, decanedicarboxylic acid, dodecanedicarboxylic acid, octadecanedicarboxylic acid, decylsuccinic acid, dodecylsuccinic acid, octadecylsuccinic acid, etc.), alkenedicarboxylic acids (for example, maleic acid, fumaric acid, citraconic acid, mesaconic acid, dedecenylsuccinic acid, pentadecenylsuccinic acid, octadecenylsuccinic acid, dimeric acid, etc.), and aromatic dicarboxylic acids (for example, phthalic acid, isophthalic acid, terephthalic acid, naphthalenedicarboxylic acid, etc.) and the like. These may also be used in the form of acid anhydrides and (for example $C_{1-8}$) alkyl esters.

Examples of diols include alkylene glycols (for example, ethylene glycol, 1,2-propanediol, 1,3-propanediol, 1,4-butanediol, 1,6-hexanediol, 1,7-heptanediol, 1,8-octanediol, 1,9-nonanediol, 1,10-decanediol, 1,12-dodecanediol, 1,14-tetradecanediol, neopentyl glycol, 2,2-diethyl-1,3-propanediol, 1,4-cyclohexanedimethanol, hydrogenated bisphenol A, spiroglycol, etc.), alkylene ether glycols (for example, diethylene glycol, triethylene glycol, dipropylene glycol, etc.), bisphenols (bisphenol A, bisphenol F, bisphenol S, bisphenol A ethylene oxide 2-mol adduct, bisphenol A propylene oxide 2.5-mol adduct, etc.) and the like.

For the dicarboxylic acid and diol components, one kind may be used alone or two or more may be used in combination.

Of these dicarboxylic acids and diols, an alkanedicarboxylic acid and an alkylene glycol are preferred from the standpoint of producing a polyester with a high degree of crystallinity.

The crystalline polyester may also use a terminal blocking agent. By using a terminal blocking agent, it is possible to adjust the molecular weight, acid value, hydroxyl value and degree of crystallization and the like of the crystalline polyester. Examples of terminal blocking agents include monovalent acids and their derivatives and monohydric alcohols and the like.

Examples of monovalent acids and their derivatives include acetic acid, propanoic acid, butanoic acid, pentanoic acid, hexanoic acid, heptanoic acid, octanoic acid, nonanoic acid, decanoic acid, lauric acid, stearic acid, benzoic acid and acid anhydrides of these. Examples of monohydric alcohols include methanol, ethanol, propanol, butanol, pentanol, hexanol, heptanol, octanol, nonanol, decanol, lauryl alcohol, stearyl alcohol and the like.

An esterification catalyst, such as a known tin compound or titanium compound, may be used as necessary in the condensation polymerization reaction.

The crystalline polyester may be a block polymer or graft polymer having crystalline segments and amorphous segments, and preferably has amorphous segments for purposes of low-temperature fixability and heat-resistant storability. A crystalline polyester having amorphous segments may be manufactured by polycondensing a diol and a dicarboxylic acid together with an amorphous resin having a terminal carboxylic acid or a terminal carboxylic acid ester.

The weight-average molecular weight (Mw) of this crystalline polyester is preferably at least 10,000 and not more than 40,000, or more preferably at least 15,000 and not more than 35,000. If it is at least 10,000, heat-resistant storability is easily improved because the crystalline polyester contains fewer low-molecular-weight components. If it is not more than 40,000, low-temperature fixability is easily improved because it is easily compatibilized with the binder resin.

The wax is preferably an ester compound of a monohydric or polyhydric alcohol with an aliphatic monocarboxylic acid, or an ester compound of a monovalent or polyvalent carboxylic acid with an aliphatic monoalcohol.

Examples of monohydric alcohols include myristyl alcohol, cetanol, stearyl alcohol, arachyl alcohol, behenyl alcohol, tetracosanol, hexacosanol, octacosanol, and triacontanol.

Examples of dihydric or polyhydric alcohols include aliphatic alcohols such as ethylene glycol, propylene glycol, 1,3-propanediol, 1,4-butanediol, 1,5-pentanediol, 1,6-hexanediol, 1,10-decanediol, 1, 12-dodecanediol, 1,14-tetradecanediol, 1,16-hexadecanediol, 1,18-octadecanediol, 1,20-eicosandsdiol, 1,30-triacontanediol, diethylene glycol, dipropylene glycol, 2,2,4-trimethyl-1,3-pentanediol, neopentyl glycol, glycerin, trimethylol propane, pentaerythritol, dipentaerythritol and pentaglycerol; alicyclic alcohols such as 1,4-cyclohexanedimethanol, spiroglycol, hydrogenated bisphenol A, phloroglucitol, quercitol and inositol; aromatic alcohols such as 1,4-phenylene glycol, bisphenol A and tris(hydroxymethyl)benzene; sugars such as D-erythrose, L-arabinose, D-mannose, D-galactose, D-fructose, L-rhamnose, saccharose, maltose and lactose; and sugar alcohols such as erythrite, D-threite, L-arabitol, adnitol, and xylitol.

Examples of monovalent carboxylic acids include acetic acid, butyric acid, caproic acid, enanthic acid, caprylic acid, pelargonic acid, capric acid, undecanoic acid, lauric acid, myristic acid, palmitic acid, stearic acid, margaric acid, arachidic acid, cerotic acid, melissic acid, erucic acid, brassidic acid, sorbic acid, oleic acid, linolic acid, linolenic acid, behenic acid, tetrolic acid, ximenynic acid, cyclohexanecarboxylic acid, benzoic acid, toluic acid and cuminic acid.

Examples of bivalent or polyvalent carboxylic acids include butanedioic acid (succinic acid), pentanedioic acid (glutaric acid), hexanedioic acid (adipic acid), heptanedioic acid (pimelic acid), octanedioic acid (suberic acid), nonanedioic acid (azelaic acid), decanedioic acid (sebacic acid), dodecanedioic acid, phthalic acid, isophthalic acid, terephthalic acid, trimesic acid, trimellitic acid and hernirnellitic acid.

Of these, one or more of an ester compound of a monohydric or dihydric alcohol with an aliphatic monocarboxylic acid and an ester compound of a monovalent or bivalent carboxylic acid with an aliphatic monoalcohol is preferred. With these esters, low-temperature fixability and heat-resistant storability are easily achieved at the same time because of the high degree of crystallinity and the plasticization effect on the binder resin.

The hydrophobic parameter HP2 of the fixing auxiliary agent preferably fulfills the following Formula (2) in its relationship with the hydrophobic parameter HP1 of the resin having an acidic functional group.

$$|HP1-HP2| \leq 0.30 \quad \text{Formula (2)}$$

In Formula (2), HP1 represents the volume fraction of heptane at the point of precipitation by the resin having an acidic functional group as measured by the addition of heptane to a solution containing 0.01 mass parts of the resin having an acidic functional group and 1.48 mass parts of chloroform, and HP2 represents the volume fraction of heptane at the point of precipitation by the fixing auxiliary agent as measured by the addition of heptane to a solution containing 0.01 mass parts of the fixing auxiliary agent and 1.48 mass parts of chloroform.

When Formula (2) above is satisfied, compatibility is enhanced between the resin having an acidic functional group and the fixing auxiliary agent, and tinting strength and low-temperature fixability are easily improved. Moreover a difference of not more than 0.15 in Formula (2) is desirable because compatibility is further enhanced, and tinting strength, low-temperature fixability and heat-resistant storability are thus easily improved. There is no particular lower limit to |HP1−HP2|, and because it is an absolute value, it could theoretically be at least 0. HP2 can be controlled by changing the types of the alcohol and the acid constituting the fixing auxiliary agent.

In a preferred embodiment of the present invention, the toner particle contains at least one of a crystalline polyester and a wax, and HP1 and HP2 fulfill the conditions shown below. Given HP1 as the hydrophobic parameter of the resin having an acidic functional group and HP2 as the hydrophobic parameter of the crystalline polyester or wax, HP1 is at least 0.60, and satisfies the following Formula (2).

$$|HP1-HP2| \leq 0.30 \quad \text{Formula (2)}$$

(In Formula (2), HP1 represents the volume fraction of heptane at the point of precipitation by the resin having an acidic functional group as measured by the addition of heptane to a solution containing 0.01 mass parts of the resin having an acidic functional group and 1.48 mass parts of chloroform, and HP2 represents the volume fraction of heptane at the point of precipitation by the crystalline polyester or wax as measured by the addition of heptane to a solution containing 0.01 mass parts of the crystalline polyester or wax and 1.48 mass parts of chloroform.)

The content of the fixing auxiliary agent is preferably at least 3.0 mass % and not more than 20.0 mass %, or more preferably at least 5.0 mass % and not more than 15.0 mass % as a percentage of the total of the binder resin and the fixing auxiliary agent. If the content is at least 3.0 mass %, adequate low-temperature fixability is obtained, while if it is not more than 20.0 mass %, low-temperature fixability can be maintained without sacrificing heat-resistant storability.

The content of the resin having an acidic functional group is preferably at least 5.0 mass parts and not more than 40.0 mass parts, or more preferably at least 10.0 mass parts and not more than 30.0 mass parts per 100 mass parts of the fixing auxiliary agent. If the percentage contents of the fixing auxiliary agent and the resin having an acidic functional group are within these ranges, the two components blend well together and aggregation caused by excess components is less likely. It is thus easier to achieve the effects of pigment dispersion and low-temperature fixing at the same time.

A known resin such as a vinyl resin, maleic acid copolymer, polyester resin or epoxy resin may be used as the binder resin in the toner of the present invention.

A vinyl resin is a resin obtained by polymerizing a radical polymerizable vinyl monomer. Specifically, in addition to the vinyl monomers listed above with reference to the resin having an acidic functional group, a polyfunctional polymerizable monomer may be used.

Examples of polyfunctional polymerizable monomers include diethylene glycol diacrylate, triethylene glycol diacrylate, tetraethylene glycol diacrylate, polyethylene glycol diacrylate, 1,6-hexanediol diacrylate, neopentyl glycol diacrylate, tripropylene glycol diacrylate, polypropylene glycol diacrylate, 2,2'-bis(4-(acryloxydiethoxy)phenyl)propane, trimethylol propane triacrylate, tetramethylol methane tetraacrylate, ethylene glycol dimethacrylate, diethylene glycol dimethacrylate, triethylene glycol dimethacrylate, tetraethylene glycol dimethacrylate, polyethylene glycol dimethacrylate, 1,3-butylene glycol dimethacrylate, 1,6-hexanediol dimethacrylate, neopentyl glycol dimethacrylate, polypropylene glycol dimethacrylate, 2,2'-bis(4-(methacryloxydiethoxy)phenyl)propane, 2,2'-bis(4-(methacryloxypolyethoxy)phenyl)propane, trimethylol propane trimethacrylate, tetramethylol methane tetramethacrylate, divinyl benzene, divinyl naphthalene and divinyl ether.

These may be used individually, or a combination of two or more may be used.

Examples of polycondensable monomers that can be used in the polyester resin include polyvalent carboxylic acids and polyols. Specifically, the dicarboxylic acids and diols listed above with reference to the fixing auxiliary agent may be used.

The toner of the present invention may also contain a charge control agent. A conventional known charge control agent may be used as the charge control agent in the toner of the present invention. Examples of negative charge control agents include metal compounds of aromatic carboxylic acids such as salicylic acid, alkylsalicylic acid, dialkylsalicylic acid, naphthoic acid and dicarboxylic acid; polymers or copolymers having sulfonic acid groups, sulfonate groups or sulfonic acid ester groups; metal salts or metal complexes of azo dyes or azo pigments; and boron compounds, silicon compounds and calixarenes.

Examples of positive charge control agents include quaternary ammonium salts and polymeric compounds having quaternary ammonium salts in the side chains; and guanidine compounds, nigrosine compounds and imidazole compounds.

Monopolymers of vinyl monomers containing sulfonic acid groups, such as styrenesulfonic acid, 2-acrylamido-2-methylpropane sulfonic acid, 2-methacrylamido-2-methylpropane sulfonic acid, vinylsulfonic acid and methacrylsulfonic acid, or copolymers of vinyl monomers with these vinyl monomers having sulfonic acid groups, can be used as the polymers or copolymers having sulfonate groups or sulfonic acid ester groups.

The content of the charge control agent is preferably at least 0.01 mass parts and not more than 5.00 mass parts per 100 mass parts of the binder resin.

The toner of the present invention may also contain an external additive with the aim of improving the flowability of the toner. A conventional known external additive may be used as the external additive. Examples include primary silica fine particles such as wet silica or dry silica, or such primary silica fine particles that have been surface treated with a treatment agent such as a silane coupling agent, titanium coupling agent or silicone oil; metal oxide fine particles such as titanium oxide fine particles, aluminum oxide fine particles or zinc oxide fine particles, or metal oxide fine particles in which the metal oxide has been hydrophobically treated; fatty acid metal salts such as zinc stearate, calcium stearate and zinc stearate; metal complexes of aromatic carboxylic acids such as salicylic acid, alkylsalicylic acid, dialkylsalicylic acid, naphthoic acid and dicarboxylic acid; fine particles of clay minerals such as hydrotalcite; and fluorine resin fine particles such as vinylidene fluoride fine particles, and polytetrafluoroethylene fine particles. Of these, silica fine particles obtained by treating primary silica fine particles with the treatment agent are preferred because they provide superior flowability and triboelectric charge properties.

The added amount of the external additive is preferably at least 0.1 mass parts and not more than 5.0 mass parts per 100 mass parts of the toner particle.

The method for manufacturing the toner particle may be any kind of manufacturing method. Examples include a suspension polymerization method in which a solution of a polymerizable monomer for forming a binder resin, a fixing auxiliary agent, a pigment, and a resin having an acidic functional group and the like is suspended in an aqueous solvent and polymerized; a kneading pulverization method in which various toner-forming materials including a binder resin, a fixing auxiliary agent, a pigment and a resin having an acidic functional group are kneaded, pulverized and classified; an emulsion aggregation method in which a dispersion of an emulsified binder resin is mixed together with a dispersion of a fixing auxiliary agent, a pigment, and a resin having an acidic functional group and the like, aggregated, and heat fused to obtain a toner particle; an emulsion polymerization and aggregation method in which a dispersion formed by emulsion polymerization of a polymerizable monomer for forming a binder resin is mixed together with a dispersion of a fixing auxiliary agent, a pigment, and a resin having an acidic functional group and the like, aggregated, and heat fused to obtain a toner particle; and a dissolution suspension method in which a binder resin, a fixing auxiliary agent and a solution of a pigment and a resin having an acidic functional group and the like are suspended and granulated in an aqueous medium.

Of these, the toner particle of the present invention is preferably manufactured by a suspension polymerization method or a dissolution suspension method in which a particle is formed by granulation in an aqueous medium. When a particle is formed by granulation in an aqueous medium, heat-resistant storability is easily improved because the fixing auxiliary agent is easily enveloped inside the toner particle. That is, the method for manufacturing the toner particle preferably has comprises step (i) or step (ii) below:

(i) a step of granulating, in an aqueous medium, a polymerizable monomer composition containing a polymerizable monomer capable of forming the binder resin, the resin having an acidic functional group, the pigment, and the fixing auxiliary agent, and then polymerizing the polymerizable monomer contained in the polymerizable monomer composition to thereby manufacture a toner particle;

(ii) a step of granulating, in an aqueous medium, an organic solvent dispersion containing the binder resin, the pigment, the resin having an acidic functional group and the fixing auxiliary agent in an organic solvent, to thereby manufacture a toner particle.

The vinyl monomers listed above are examples of polymerizable monomers to be used for obtaining a toner particle by suspension polymerization.

When the toner particle is obtained by suspension polymerization, a polymerization initiator may also be used. A known polymerization initiator may be used as the polymerization initiator. Examples include azo or diazo polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide polymerization initiators such as benzoyl peroxide, t-butylperoxy-2-ethylhexanoate, 1,1,3,3-tetramethylbutylperoxy-2-ethylhexanoate, t-butylperoxypivalate, t-butylperoxyisobutyrate, t-butylperoxyneodecanoate, methylethylketone peroxide, diisopropyl peroxycarbonate, cumene hydroperoxide, 2,4-dichlorobenzoyl peroxide and lauroyl peroxide.

When the toner particle is obtained by suspension polymerization, a known chain transfer agent or polymerization inhibitor may also be used.

When the toner particle is obtained by suspension polymerization, an inorganic or organic dispersion stabilizer may also be included in the aqueous medium. A known dispersion stabilizer may be used as the dispersion stabilizer.

Examples of inorganic dispersion stabilizers include phosphate salts such as hydroxyapatite, tribasic calcium phosphate, dibasic calcium phosphate, magnesium phosphate, aluminum phosphate and zinc phosphate; carbonate salts such as calcium carbonate and magnesium carbonate; metal hydroxides such as calcium hydroxide, magnesium hydroxide and aluminum hydroxide; sulfate salts such as calcium sulfate and barium sulfate; and calcium metasilicate; bentonite; silica; and alumina.

Examples of organic dispersion stabilizers include polyvinyl alcohol, gelatin, methylcellulose, methylhydroxypropyl cellulose, ethylcellulose, carboxymethyl cellulose sodium salt, polyacrylic acids and salts thereof, and starch.

When an inorganic compound is used as the dispersion stabilizer, a commercial compound may be used as is, but the inorganic compound may also be produced and used in an aqueous medium in order to obtain finer particles. For example, in the case of a calcium phosphate such as hydroxyapatite or tribasic calcium phosphate, an aqueous phosphate salt solution and an aqueous calcium salt solution can be mixed under high agitation.

When the toner particle is obtained by suspension polymerization, furthermore a surfactant may be included in the aqueous medium. A known surfactant may be used as the surfactant. Examples include anionic surfactants such as sodium dodecylbenzene sulfate or sodium oleate; cationic surfactants; amphoteric surfactants; and nonionic surfactants.

The organic solvent used to obtain the toner particle by the dissolution suspension method is preferably a solvent that is not miscible with water and is easily removable by heating. Examples include ethyl acetate and methylethylketone.

When the toner particle is obtained by the dissolution suspension method, an inorganic or organic dispersion stabilizer may also be included in the aqueous medium. The dispersion stabilizers listed above with reference to the suspension polymerization method may be used as the dispersion stabilizer.

The methods of measuring the various physical properties in the present invention are explained next.

(Glass Transition Temperature (Tg))

The glass transition temperature (Tg) is measured with a Q1000 differential scanning calorimeter (TA Instruments) in accordance with ASTM D3418-82.

The melting points of indium and zinc are used for temperature correction of the device detection part, and the heat of fusion of indium is used for correction of the calorific value. Specifically, 2 mg of a measurement sample is weighed and placed in an aluminum pan, and using an empty aluminum pan for reference, the temperature is raised at a rate of 10° C./minute within the measurement range of 0° C. to 150° C. The sample is held for 15 minutes at 100° C., and then cooled from 100° C. to 0° C. at a rate of 10° C./minute. It is then held for 10 minutes at 0° C., and measured between 0° C. and 100° C. at a rate of temperature increase of 10° C./minute.

The glass transition temperature (Tg) is taken to be the temperature at the point of intersection between the curve of the stepwise change part of the glass transition and a straight line longitudinally equidistant from the extended straight lines of the baselines prior to and subsequent to the appearance of the change in specific heat in the specific heat change curve during the second temperature increase.

(Hydrophobic Parameters HP1 and HP2)

0.01 g of the resin having an acidic functional group is taken in an 8 mL sample jar and dissolved in 1.48 g (1.0 mL) of chloroform, and the initial mass (W1) is measured. A stir bar is placed in the sample jar, and the mixture is stirred with a magnetic stirrer while:

(a) 100 mg of heptane is added dropwise, and stirring is continued for 20 seconds; and (b) white turbidity is confirmed with the naked eye.

If there is no white turbidity, operations (a) and (b) are repeated. Once white turbidity is confirmed (precipitation point), the operation is stopped, and the mass (W2) is measured. All measurements are performed at 25° C., normal pressure (1 atm).

HP1 is calculated by the following formula. At 25° C. and 1 atm the specific gravity of heptane is 0.684, and that of chloroform is 1.48.

$$HP=\{(W2-W1)/0.684\}/\{((W2-W1)/0.684)+1\}$$

The same measurement is performed three times, and the average value given as the HP1.

HP2 is measured in the same way by substituting the fixing auxiliary agent for the resin having an acidic functional group in the measurement method described above.

(Structure of Pigment (NMR))

The structure of the pigment, such as the average number of basic segments bound to the organic dye, is analyzed by nuclear magnetic resonance spectroscopy (LH-NMR).

Measurement equipment: JNM-EX400 (JEOL Ltd.)
Measurement frequency: 400 MHz
Pulse condition: 5.0 μs
Frequency range: 10,500 Hz
Cumulative number: 1024
Measurement solvent: DMSO-d6

The sample is dissolved as much as possible in DMSO-d6, and measured under the above conditions. The structure of the sample, such as the average number of basic segments and the like, is calculated based on the proton ratio and chemical shift value of the resulting spectrum.

(Acid Value of Resin Having Acidic Functional Group)

The acid value is the number of mg of potassium hydroxide needed to neutralize the acid contained in 1 g of sample. The acid value in the present invention is measured in accordance with JIS K 0070-1992, and specifically is measured by the following procedures.

Titration is performed using a 0.1 mol/l potassium hydroxide ethanol solution (Kishida Chemical Co., Ltd.). The factor of this potassium hydroxide ethanol solution can be determined using an AT-510 potentiometric titrator (Kyoto Electronics Manufacturing Co., Ltd.). 100 mL of 0.1 mol/l hydrochloric acid is taken in a 250 mL tall beaker, and titrated with the potassium hydroxide ethanol solution, and the factor is determined from the amount of potassium hydroxide ethanol solution required for neutralization. The 0.1 mol/l hydrochloric acid is prepared in accordance with JIS K 8001-1998.

The measurement conditions for acid value measurement are shown below.

Titration unit: AT-510 potentiometric titrator (Kyoto Electronics Manufacturing Co., Ltd.)
Electrodes: Composite glass electrode double-junction type (Kyoto Electronics Manufacturing Co., Ltd.)
Control software for titration unit: AT-WIN
Titration analysis software: Tview The titration parameters and control parameters for titration are set as follows.

(Titration Parameters)
Titration mode: Blank titration
Titration format: Full-volume titration
Maximum titer: 20 mL
Waiting time before titration: 30 seconds
Titration direction: Automatic
(Control Parameters)
End point judgment potential: 30 dE
End point judgment potential value: 50 dE/dmL
End point detection judgment: Not set
Control speed mode: Standard
Gain: 1
Data sampling potential: 4 mV
Data sampling titer: 0.1 mL
(Main Test)

1.00 g of measurement sample is weighed into a 250 mL tall beaker, 100.0 g of a mixed solution of 70.0 g of toluene and 30.0 g of ethanol is added, and the sample is dissolved over the course of 1 hour. It is then titrated with the potassium hydroxide ethanol solution using the previous potentiometric titrator.

(Blank Test)

Titration is performed by the same operations but without using a sample (that is, using only a mixed solution of 70.0 g of toluene and 30.0 g of ethanol).

(Calculating Acid Value)

The results are entered into the following formula to calculate the acid value.

$$A=[(C-B)\times f\times 5.611]/S$$

(In the formula, A is the acid value (mg KOH/g), B is the amount (mL) of the potassium hydroxide ethanol solution added in the blank test, C is the amount (mL) of the potassium hydroxide ethanol solution added in the main test, f is the factor of the potassium hydroxide solution, and S is the sample (g).)

(pKa and Base Value of Basic-Treated Pigment)

The base value of the pigment is the number of mg of potassium hydroxide equivalent to hydrochloric acid needed to neutralize the base contained in 1 g of sample. The base value of the pigment is measured in the same way as the acid value of the resin, and specifically is measured by the following procedures.

Titration is performed using a 0.1 mol/l hydrochloric acid ethanol solution. The 0.1 mol/l hydrochloride acid is prepared in accordance with JIS K 8001-1998.

The measurement conditions for base value measurement are as follows.

Titration unit: AT-510 potentiometric titrator (Kyoto Electronics Manufacturing Co., Ltd.)

Electrodes: Composite glass electrode double-junction type (Kyoto Electronics Manufacturing Co., Ltd.)
Control software for titration unit: AT-WIN
Titration analysis software: Tview The titration parameters and control parameters for titration are set as follows.

(Titration Parameters)
Titration mode: Blank titration
Titration format: Full-volume titration
Maximum titer: 20 mL
Waiting time before titration: 30 seconds
Titration direction: Automatic
(Control Parameters)
End point judgment potential: 30 dE
End point judgment potential value: 50 dE/dmL
End point detection judgment: Not set
Control speed mode: Standard
Gain: 1
Data sampling potential: 4 mV
Data sampling titer: 0.1 mL
(Main Test)

10.0 g of pigment and 200.0 g of a mixed solution of 140.0 g of toluene and 60.0 g of ethanol are placed in a pressure-resistant container together with 250 g of 0.8 mm glass beads, and the pigment is dispersed for 5 hours with a paint shaker (Toyo Seiki Seisaku-Sho, Ltd.) to obtain a pigment dispersion. 100.0 g of this pigment dispersion is then weighed into a tall beaker. This is then titrated with the hydrochloric acid ethanol solution using the potentiometric titrator.

(Blank Test)

Titration is performed by the same operations but without the sample (that is, using only a mixed solution of 140.0 g of toluene and 60.0 g of ethanol).

(Calculating Base Value)

The results were entered into the following formula to calculate the base value.

$$BV=[(C-B)\times f\times 5.611]/S$$

(In the formula, BV is the base value (mg KOH/g), B is the added amount (mL) of the hydrochloric acid ethanol solution in the blank test, C is the added amount (mL) of the hydrochloric acid ethanol solution in the main test, f is the factor of a potassium hydroxide solution, and S is the sample (g).)

(Determining pKa of Pigment)

The point at which the pH change gradient is the greatest in the titration curve obtained by base value measurement is taken as the neutralization point. The pKa of the pigment is determined as follows. The pH at half the amount of 0.1 mol/l hydrochloric acid ethanol solution required up to the neutralization point is read from the titration curve, and this pH value is given as the pKa. However, the pH at the beginning of titration is given as the pKa in cases in which the base value is less than 0.1 and the neutralization point is difficult to determine.

(Weight-Average Molecular Weight and Number-Average Molecular Weight of Resin Having Acidic Functional Group and Crystalline Polyester)

First, the resin having an acidic functional group or the crystalline polyester is dissolved at room temperature in tetrahydrofuran (THF). The resulting solution is then filtered with a 0.2 μm pore diameter solvent-resistant membrane filter (Sample Pretreatment Cartridge, Tosoh Corporation) to obtain a sample solution. The concentration of THF-soluble components in the sample solution is adjusted to 0.8 mass %. Measurement is performed under the following conditions using this sample solution.

Equipment: High-speed "HLC-8220GPC" GPC unit (Tosoh Corporation)
Columns: LF-604 (duplicate, Showa Denko K.K.)
Eluent: THF
Flow rate: 0.6 mL/minute
Oven temperature: 40° C.
Sample injection volume: 0.020 mL A molecular weight calibration curve prepared using standard polystyrene resin (for example product name "TSK standard polystyrene F-850, F-450, F-288, F-128, F-80, F-40, F-20, F-10, F-4, F-2, F-1, A-5000, A-2500, A-1000, A-500" (Tosoh Corporation)) is used for calculating the molecular weight of each sample.

(Methods for Measuring Weight-Average Particle Diameter (D4) of Toner Particle and Toner)

The weight-average particle diameters (D4) of the toner particle and toner are measured using a Coulter Counter Multisizer 3 (Trademark) precise particle size analyzer (Beckman Coulter, Inc.). Measurement is performed under the following conditions.

Effective measurement channels: 25,000
Total number of control motors: 50,000
Aperture: 100 μm
Current: 1600 μA
Gain: 2

Measurement is performed using a Kd value obtained with "standard particles 10.0 μm" (Beckman Coulter, Inc.).

The measurement data are analyzed with the dedicated software attached to the apparatus, to calculate the weight-average particle diameter (D4) and number-average particle diameter (D1). The weight-average particle diameter (D4) is the "average diameter" on the "analysis/volume statistical value (arithmetic average)" screen when graph/vol % is set by the dedicated software, while the number-average particle diameter (D1) is the "average diameter" on the "analysis/volume statistical value (arithmetic average)" screen when graph/number % is set by the dedicated software.

(Measurement of Melting Point)

The melting point of the fixing auxiliary agent is measured in accordance with ASTM D3418-82 using a Q1000 differential scanning calorimeter (TA Instruments).

The melting points of indium and zinc are used for temperature correction of the device detection part, and the heat of fusion of indium is used for correction of the calorific value.

Specifically, 5 mg of sample is weighed and placed in an aluminum pan, and using an empty aluminum pan for reference, measurement is performed at a ramp rate and ramp down rate of 10° C./minute within the measurement temperature range of 0° C. to 150° C. During measurement, the temperature is first increased to 150° C., then reduced to 0° C., and then increased again. The peak temperature of the maximum endothermic peak in the DSC curve in the range of 0° C. to 150° C. during this second temperature increase is taken as the melting point.

EXAMPLES

The present invention is explained in detail below using examples, but the present invention is not limited to these examples. Unless otherwise specified, "parts" and "%" values in the text are all based on mass.

(Manufacture of Basic-Treated Pigment)

A basic-treated pigment was manufactured according to the manufacturing methods described in Japanese Patent No. 4484171.

(Manufacture of Treatment Agent 1)

91.4 parts of 98% sulfuric acid, 36.7 parts of 25% fuming sulfuric acid, 6.3 parts of diethylamine and 2.8 parts of 92% paraformaldehyde were loaded at 40° C. into a reaction vessel equipped with a stirrer, a condenser, a thermometer and a nitrogen introduction tube. This was stirred for 30 minutes at 40° C., after which 8.0 parts of copper phthalocyanine were slowly added. After addition, the reaction solution was warmed, and reacted for 5 hours at 80° C. After completion of the reaction, the reaction solution was cooled to room temperature and transferred to 750 parts of water, and the slurry was filtered out, water washed and dried to obtain a treatment agent (organic dye having basic segments) 1 having introduced diethylaminomethyl groups.

When the resulting treatment agent 1 was analyzed by NMR, an average of 2.1 diethylaminomethyl groups were found to have been introduced. The physical properties of the treatment agent 1 are shown in Table 1.

(Manufacture of Treatment Agents 2 to 7)

The treatment agents 2 to 7 shown in Table 1 below were manufactured in the same way as the treatment agent 1 except that the structure of the amine compound and the base skeleton were changed appropriately.

TABLE 1

| | Structure | y (average number) |
|---|---|---|
| Treatment agent 1 | 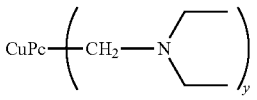 | 2.1 |
| Treatment agent 2 | 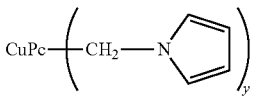 | 2.5 |
| Treatment agent 3 | 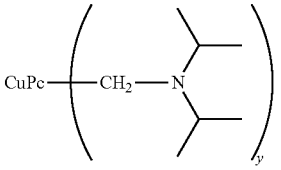 | 2.6 |
| Treatment agent 4 | 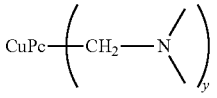 | 2.0 |
| Treatment agent 5 | 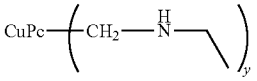 | 1.9 |
| Treatment agent 6 | 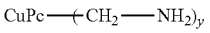 | 1.7 |
| Treatment agent 7 | 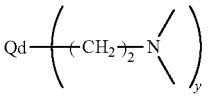 | 2.2 |

In Table 1, CuPc represents copper phthalocyanine and Qd represents 2,9-dimethylquinacridone.

(Manufacture of Basic-Treated Pigment 1)

2 parts of the treatment agent 1 were added to 100 parts of C.I. Pigment Blue 15:3, and mixed by shaking for 24 hours to prepare a basic-treated pigment 1. The physical properties of the resulting basic-treated pigment 1 are shown in Table 2.

(Manufacture of Basic-Treated Pigments 2 to 13)

The basic-treated pigments 2 to 13 shown in Table 2 below were manufactured in the same way as the basic-treated pigment 1 except that the type of treatment agent, the type of pigment and the mixing ratios were changed appropriately.

(Manufacture of Basic-Treated Pigment 14)

914 parts of 98% sulfuric acid, 367 parts of 25% fuming sulfuric acid, 1.2 parts of diethylamine and 28 parts of 92% paraformaldehyde were loaded at 40° C. into a reaction vessel equipped with a stirrer, a condenser, a thermometer and a nitrogen introduction tube, and stirred for 30 minutes at 40° C., after which 80 parts of copper phthalocyanine were slowly added. After addition the temperature of the reaction solution was raised, and a reaction was performed for 5 hours at 80° C. After completion of the reaction, the reaction solution was cooled to room temperature and transferred to 7500 parts of water, and the slurry was filtered out, water washed and dried to obtain a basic-treated pigment 14 containing a pigment having introduced diethylaminomethyl groups. The properties of the basic-treated pigment 14 are shown in Table 2.

TABLE 2

| | Treatment agent | | Pigment | | Basic-treated pigment | |
|---|---|---|---|---|---|---|
| | Type | Mass parts | Type | Mass parts | pKa | Base value |
| Basic-treated pigment 1 | Treatment agent 1 | 2 | PB 15:3 | 100 | 5.5 | 1.5 |
| Basic-treated pigment 2 | Treatment agent 2 | 2 | PB 15:3 | 100 | 4.4 | 1.6 |
| Basic-treated pigment 3 | Treatment agent 3 | 2 | PB 15:3 | 100 | 5.0 | 1.5 |
| Basic-treated pigment 4 | Treatment agent 4 | 2 | PB 15:3 | 100 | 5.7 | 1.6 |
| Basic-treated pigment 5 | Treatment agent 5 | 2 | PB 15:3 | 100 | 6.6 | 1.5 |
| Basic-treated pigment 6 | Treatment agent 6 | 2 | PB 15:3 | 100 | 7.4 | 1.3 |
| Basic-treated pigment 7 | Treatment agent 1 | 0.3 | PB 15:3 | 100 | 5.2 | 0.5 |
| Basic-treated pigment 8 | Treatment agent 1 | 1 | PB 15:3 | 100 | 5.4 | 1.0 |
| Basic-treated pigment 9 | Treatment agent 1 | 4 | PB 15:3 | 100 | 5.6 | 2.8 |
| Basic-treated pigment 10 | Treatment agent 1 | 5 | PB 15:3 | 100 | 5.7 | 3.5 |
| Basic-treated pigment 11 | Treatment agent 1 | 2 | CB | 100 | 5.4 | 1.6 |
| Basic-treated pigment 12 | Treatment agent 1 | 2 | PR 122 | 100 | 5.6 | 1.5 |
| Basic-treated pigment 13 | Treatment agent 7 | 2 | PR 122 | 100 | 5.6 | 1.6 |
| Basic-treated pigment 14 | (Directly treated PB 15:3 pigment) | | | | 5.4 | 1.4 |

In Table 2, C.I. Pigment Blue 15:3 is shown as PB 15:3, carbon black as CB, and C.I. Pigment Red 122 as PR 122.

(Synthesis of Resins having Acidic Functional Groups)

The compounds C1 to C6 shown in Formula (9) and in Table 3 were manufactured as structures having acidic functional groups for constituting resins having acidic functional groups.

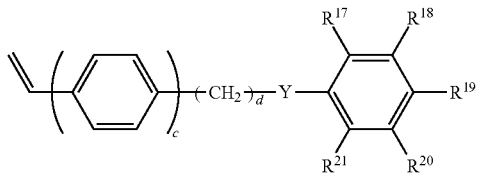

(9)

TABLE 3

| Structure having acidic functional group (Formula (9)) | c | d | Y | $R^{17}$ | $R^{18}$ | $R^{19}$ | $R^{20}$ | $R^{21}$ |
|---|---|---|---|---|---|---|---|---|
| Compound C1 | 1 | 1 | —O— | —H | —OH | —COOH | —H | —H |
| Compound C2 | 1 | 1 | —O— | —H | —COOH | —OH | —H | —H |
| Compound C3 | 1 | 1 | —O— | —H | —COOH | —OH | —tBu | —H |
| Compound C4 | 1 | 1 | —O— | —H | —COOH | —OH | $—CH(CH)_3C_6H_{13}$ | —H |
| Compound C5 | 1 | 1 | —O— | —OH | —COOH | —H | —H | —H |
| Compound C6 | 0 | 0 | Single bond | —H | —COOH | —OH | —H | —H |

In the table, tBu represents tert-butyl.

(Synthesis of Compound C1)

The compound C1 was synthesized by the methods described in Japanese Patent Application Publication No. 2014-222356. Specifically, 78.6 parts of 2,4-dihydroxybenzoic acid were dissolved in 400 parts of methanol, 152 parts of potassium carbonate were added, and the mixture was heated to 60° C. A solution of 87.9 parts of 4-(chloromethyl) styrene dissolved in 100 parts of methanol was slowly added dropwise to this reaction solution, which was then reacted for 2.5 hours at 60° C. The reaction solution was cooled to room temperature, filtered, and washed with methanol. The resulting precipitate was dispersed in 1000 parts of water that had been adjusted to pH 1 with hydrochloric acid, filtered, water washed and dried at 80° C. to obtain the compound C1 shown by Formula (7) below.

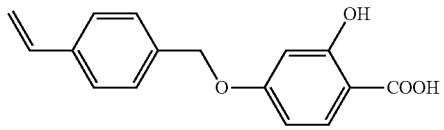

(7)

(Synthesis of Compounds C2 to C5)

Compounds C2 to C5 were synthesized in the same way as the compound C1 by the synthesis methods described in Japanese Patent Application Publication No. 2014-222356.

(Synthesis of Compound C6)

The compound C6 shown by Formula (10) below was synthesized by the methods described in Japanese Patent Application Publication No. S63-270060.

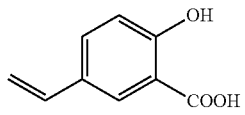

(10)

(Manufacture of Resin (Pigment Treatment Agent) S1 having Acidic Functional Group)

60.0 parts of toluene were loaded into a reaction vessel equipped with a stirrer, a condenser, a thermometer and a nitrogen introduction tube, and heated to reflux at 125° C. in a flow of nitrogen.

Next, the following raw materials and solvents were mixed to prepare a monomer mixture.

| | |
|---|---|
| Styrene | 100 parts |
| Compound C1 | 8.62 parts |
| Stearyl methacrylate | 25.2 parts |
| Toluene | 60.0 parts |

9.00 parts of the polymerization initiator t-butylperoxi-isopropyl monocarbonate (75% hydrocarbon solvent dilution) were further mixed into this monomer mixture, which was then added dropwise to the previous reaction vessel over the course of 30 minutes. This was reacted under heating reflux, and cooled to room temperature once the desired molecular weight had been reached. The resulting polymer-containing composition was added dropwise to a mixture of 1400 parts of methanol and 10 parts of acetone, to precipitate a resin composition. The resulting resin composition was filtered, washed twice with 200 parts of methanol, and dried at 60° C. under reduced pressure to obtain a resin S1 having an acidic functional group.

The resulting resin S1 having an acidic functional group had a hydrophobic parameter HP1 of 0.78, a weight-average molecular weight of 32,000, and an acid value of 14.3 mg KOH/g.

(Manufacture of Resins S2 to S17 having Acidic Functional Groups)

Resins S2 to S17 having acidic functional groups were manufactured in the same way as the resin S1 having an acidic functional group except that the types and amounts of the monomers were changed appropriately as shown in Table 4. The properties of the resins S2 to S17 having acidic functional groups are shown in Table 4.

TABLE 4

| Pigment dispersant | Composition: Styrene (Moles) | Compound having acidic functional group (Structure) | (Moles) | STMA (Moles) | Physical properties: Weight-average molecular weight (Mw) | Hydrophobicity parameter (HP1) | Acid value (mg KOH/g) |
|---|---|---|---|---|---|---|---|
| S1 | 90 | C1 | 3 | 7 | 32000 | 0.78 | 14.3 |
| S2 | 83 | C1 | 7 | 10 | 31000 | 0.65 | 35.3 |
| S3 | 85 | C1 | 5 | 10 | 31000 | 0.74 | 23.6 |
| S4 | 92 | C1 | 1 | 7 | 30000 | 0.88 | 5.1 |
| S5 | 92.5 | C1 | 0.5 | 7 | 30000 | 0.90 | 2.5 |
| S6 | 90 | C2 | 3 | 7 | 32000 | 0.78 | 14.0 |
| S7 | 90 | C3 | 3 | 7 | 31000 | 0.81 | 13.6 |
| S8 | 90 | C4 | 3 | 7 | 28000 | 0.82 | 12.9 |
| S9 | 90 | C5 | 3 | 7 | 32000 | 0.78 | 14.0 |
| S10 | 87 | C6 | 3 | 10 | 28000 | 0.76 | 14.7 |
| S11 | 90 | C7 | 3 | 7 | 32000 | 0.78 | 12.8 |
| S12 | 87 | C8 | 3 | 10 | 31000 | 0.76 | 8.7 |
| S13 | 90 | C1 | 3 | 7 | 8000 | 0.77 | 14.6 |
| S14 | 90 | C1 | 3 | 7 | 12000 | 0.78 | 14.2 |
| S15 | 90 | C1 | 3 | 7 | 74000 | 0.78 | 14.3 |
| S16 | 90 | C1 | 3 | 7 | 80000 | 0.77 | 14.4 |
| S17 | 95 | C1 | 5 | 0 | 29000 | 0.44 | 24.5 |

In Table 4, STMA represents stearyl methacrylate (n=17 in Formula (8)). The compound C7 having an acidic functional group has the structure of Formula (11) below, while compound C8 has the structure of Formula (12).

(11)

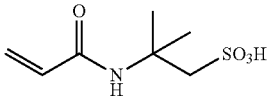

(12)

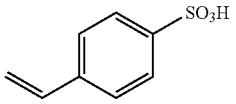

(Manufacture of Fixing Auxiliary Agent 1)

97.1 parts of sebacic acid and 83.3 parts of 1,9-nonanediol were added to a reaction vessel equipped with a stirrer, a condenser, a thermometer, a nitrogen introduction tube, a dewatering tube and a pressure reduction device, and heated to 130° C. 0.7 parts of titanium (IV) isopropoxide were added as an esterification catalyst, the temperature was raised to 160° C., and condensation polymerization was performed until the desired molecular weight was reached, to manufacture a fixing auxiliary agent (crystalline polyester) 1. The physical properties of the resulting fixing auxiliary agent 1 are shown in Table 5-1 and Table 5-2.

(Manufacture of Fixing Auxiliary Agents 2, 6, 7 and 15)

Fixing auxiliary agents 2, 6, 7 and 15 were obtained in the same way as the fixing auxiliary agent 1 except that the compositions were changed appropriately as shown in Table 5-1 and Table 5-2. The physical properties of the resulting fixing auxiliary agents are shown in Table 5-1 and Table 5-2.

The fixing auxiliary agents (crystalline polyesters) 1, 2, 6, 7 and 15 had clear endothermic peaks in differential scanning calorimetry (DSC).

TABLE 5-1

| Fixing auxiliary agent | Composition: Dicarboxylic acid (Type) | (Mol %) | Diol (Type) | (Mol %) |
|---|---|---|---|---|
| Fixing auxiliary agent 1 | Sebacic acid | 48 | 1,9-nonanediol | 52 |
| Fixing auxiliary agent 2 | 1,10-decandicarboxylic acid | 48 | 1,12-dodecanediol | 52 |
| Fixing auxiliary agent 6 | Pimelic acid | 48 | 1,5-pentanediol | 52 |
| Fixing auxiliary agent 7 | Pimelic acid | 48 | 1,10-decanediol | 52 |
| Fixing auxiliary agent 15 | 1,14-tetradecanedicarboxylic acid | 48 | 1,14-tetradacanediol | 52 |

TABLE 5-2

| Fixing auxiliary agent | Physical properties: Weight-average molecular weight (Mw) | Hydrophobicity parameter (HP 2) | Melting point (° C.) |
|---|---|---|---|
| Fixing auxiliary agent 1 | 21000 | 0.87 | 67 |
| Fixing auxiliary agent 2 | 21000 | 0.92 | 81 |
| Fixing auxiliary agent 6 | 25000 | 0.82 | 50 |
| Fixing auxiliary agent 7 | 25000 | 0.86 | 61 |
| Fixing auxiliary agent 15 | 25000 | 0.96 | 87 |

(Manufacture of Fixing Auxiliary Agent 3)

100 parts of xylene were heated to reflux at 140° C. in a reaction vessel equipped with a stirrer, a condenser, a thermometer and a pressure reduction device. A mixture of 100 parts of styrene and 6.00 parts of 2,2'-azobis(methyl isobutyrate) was then added dropwise over the course of 3 hours, and the mixture was reacted for another 3 hours. After the reaction, the xylene and residual styrene were distilled off at 160° C. under reduced pressure to obtain a vinyl polymer (1).

Next, the following raw materials and solvents were mixed in a reaction vessel equipped with a stirrer, a condenser, a thermometer, a nitrogen introduction tube, a dewatering tube and a pressure reduction device, and reacted for 4 hours at 150° C.

| | |
|---|---|
| Vinyl polymer (1) | 90.0 parts |
| 1,8-octanediol | 92.5 parts |
| Titanium (IV) isopropoxide | 0.43 parts |
| Xylene | 88.0 parts |

101 parts of 1,6-hexanedicarboxylic acid were then added, and condensation polymerization was performed at 160° C. until the desired molecular weight was reached, to obtain a fixing auxiliary agent 3. The physical properties of the resulting fixing auxiliary agent 3 are shown in Table 6-1 and Table 6-2. The fixing auxiliary agent 3 is a block polymer containing crystalline polyester segments.

(Manufacture of Fixing Auxiliary Agents 5 and 8 to 12)

Fixing auxiliary agents 5 and 8 to 12 were obtained in the same way as the fixing auxiliary agent 3 except that the compositions were changed appropriately as shown in Table 6-1 and Table 6-2. The physical properties of the resulting fixing auxiliary agents are shown in Table 6-1 and Table 6-2.

The fixing auxiliary agents 5 and 8 to 12 exhibited clear endothermnic peaks in differential scanning calorimetry (DSC). The fixing auxiliary agents are also block polymers containing crystalline polyester segments.

TABLE 6-1

| Fixing auxiliary agent | Composition: Dicarboxylic acid (Type) | Dicarboxylic acid (Mol %) | Diol (Type) | Diol (Mol %) | Styrene (Mol %) |
|---|---|---|---|---|---|
| Fixing auxiliary agent 3 | 1,6-hexanedicarboxylic acid | 28 | 1,8-octanediol | 30 | 42 |
| Fixing auxiliary agent 5 | 1,10-decanedicarboxylic acid | 28 | 1,10-decanediol | 30 | 42 |
| Fixing auxiliary agent 8 | 1,12-dodecanedicarboxylic acid | 28 | 1,12-dodecanediol | 30 | 42 |
| Fixing auxiliary agent 9 | 1,10-decanedicarboxylic acid | 35 | 1,12-dodecanediol | 37 | 28 |
| Fixing auxiliary agent 10 | 1,10-decanedicarboxylic acid | 35 | 1,12-dodecanediol | 37 | 28 |
| Fixing auxiliary agent 11 | 1,10-decanedicarboxylic acid | 35 | 1,12-dodecanediol | 37 | 28 |
| Fixing auxiliary agent 12 | 1,10-decanedicarboxylic acid | 35 | 1,12-dodecanediol | 37 | 28 |

TABLE 6-2

| Fixing auxiliary agent | Physical properties: Weight-average molecular weight (Mw) | Hydrophobicity parameter (HP 2) | Melting point (° C.) |
|---|---|---|---|
| Fixing auxiliary agent 3 | 25000 | 0.85 | 66 |
| Fixing auxiliary agent 5 | 25000 | 0.90 | 74 |
| Fixing auxiliary agent 8 | 25000 | 0.93 | 85 |
| Fixing auxiliary agent 9 | 8000 | 0.92 | 80 |
| Fixing auxiliary agent 10 | 12000 | 0.92 | 80 |
| Fixing auxiliary agent 11 | 38000 | 0.92 | 80 |
| Fixing auxiliary agent 12 | 45000 | 0.92 | 80 |

(Manufacture of Fixing Auxiliary Agents 4, 13 and 14)

The compounds shown in Table 7 were used as the fixing auxiliary agents 4, 13 and 14. Dibehenyl sebacate is a diester of sebacic acid and behenyl alcohol. Behenyl behenate is a monoester of behenic acid and behenyl alcohol. Pentaerythritol tetrastearate is a tetraester of pentaerythritol and stearic acid.

TABLE 7

| Fixing auxiliary agent | Name | Melting point |
|---|---|---|
| Fixing auxiliary agent 4 | Dibehenyl sebacate | 78 |
| Fixing auxiliary agent 13 | Behenyl behenate | 66 |
| Fixing auxiliary agent 14 | Pentaerythritol tetrastearate | 85 |

(Manufacture of Resin P1)

200 parts of xylene were loaded into a reaction vessel equipped with a stirrer, a condenser, a thermometer and a nitrogen introduction tube. 75.0 parts of styrene, 25.0 parts of n-butyl acrylate and 10.0 parts of a 75% toluene solution of the polymerization initiator 1,1,3,3-tetramethylbutylperoxy-2-ethylhexanoate were mixed, and added dropwise with stirring the previous reaction vessel. This was heated to reflux at 65° C., and once the desired molecular weight was reached the reaction solution was cooled to stop the reaction. The reaction solution was purified by solid-liquid separation in methanol, and dried at 40° C. under reduced pressure to obtain a resin P1. The resulting resin P1 had an Mn of 14,000 and an Mw of 35,000.

(Manufacture of Resin P2)

100 parts of bisphenol APO adduct, 21.7 parts of terephthalic acid and 23.5 parts of sebacic acid were added to a reaction vessel equipped with a stirrer, a thermometer, a nitrogen introduction tube, a dewatering tube and a pressure reduction device, and stirred and heated to 130° C. 0.52 parts of di(2-ethylhexaoic acid)tin were then added as an esterification catalyst, the temperature was raised to 200° C., and the mixture was condensation polymerized until the desired molecular weight was reached to obtain a resin P2. The resulting resin P2 had an Mn of 8,000 and an Mw of 27,000.

(Toner Manufacture)

(Manufacture of Toner 1)

(Preparation of Master Batch Dispersion 1)

| | |
|---|---|
| Styrene | 216 parts |
| Basic-treated pigment 1 | 36.0 parts |
| Resin S1 having acidic functional group | 3.60 parts |

These materials were introduced into an attritor (Nippon Coke & Engineering Co., Ltd.), and stirred for 180 minutes at 250 rpm, 25° C. with 180 parts of zirconia beads with a radius of 2.5 mm to prepare a master batch dispersion 1.

(Preparation of Toner Composition Solution 1)

| | |
|---|---|
| Master batch dispersion 1 | 192 parts |
| Styrene monomer | 106 parts |
| n-butyl acrylate monomer | 89.3 parts |
| Hydrocarbon wax (HNP-9, Nippon Seiro Co., Ltd.) | 27.0 parts |
| Resin A (copolymer of styrene, methacrylic acid, methyl methacrylate and 2-hydroxyethyl methacrylate, Mw = 14,800, Tg = 89° C., Acid value Av = 22 mg KOH/g, hydroxyl value OHv = 8 mg KOH/g) | 13.5 parts |
| Fixing auxiliary agent 1 | 22.5 parts |

These materials were mixed and heated to 65° C., and uniformly dissolved and dispersed for 60 minutes at 3,500 rpm with a T.K. Homomixer (Tokushu Kika Kogyo Co., Ltd.) to obtain a toner composition solution 1.

1000 parts of ion-exchange water and 480 parts of 0.1 mol/L aqueous $Na_3PO_4$ solution were added to a 2-liter four-necked flask equipped with a T.K. Homomixer, and heated to 60° C. with the T.K. Homogenizer adjusted to 10,000 rpm. 71.9 parts of 1.0 mol/L aqueous $CaCl_2$ solution and 3.90 parts of 10% hydrochloric acid were then added gradually to obtain an aqueous medium containing a calcium phosphate compound.

Next, 28.6 parts of a 75% toluene solution of the polymerization initiator 1,1,3,3-tetramethylbutylperoxy-2-ethylhexanoate were dissolved in the toner composition solution 1, which was thoroughly mixed and then added to the previous aqueous medium. This was then stirred for 10 minutes at 65° C. in a $N_2$ atmosphere with the T.K. Homomixer at 10,000 rpm to granulate a polymerizable monomer composition. This was then heated to 75° C. while being stirred with a paddle stirring blade, and polymerized for 5 hours. This was then heated to 85° C. at a ramp rate of 1° C./minute and reacted for 1 hour, and the polymerization reaction was terminated. Residual monomers were then removed from the toner particle under reduced pressure, and the aqueous medium was cooled to obtain a toner particle dispersion.

Hydrochloric acid was added to lower the pH of the toner particle dispersion to 1.4, and the dispersion was stirred for 1 hour to dissolve the calcium phosphate salt. This was then subjected to solid-liquid separation under 0.4 Mpa of pressure in a pressure filtration unit, to obtain a toner cake. Ion-exchange water was then added until the pressure filter unit was full, and the cake was washed under 0.4 Mpa of pressure. This washing operation was repeated three times, and the product was dried to obtain a toner particle 1.

1.5 parts of hydrophobic silica fine powder (number-average primary particle diameter: 10 nm) that had been surface treated with hexamethyl disilazane were added to 100 parts of the toner particle 1, and mixed for 300 seconds in an FM mixer (Nippon Coke & Engineering Co., Ltd.) to obtain a toner 1. The physical properties of the toner 1 are shown in Table 9.

(Manufacture of Toners 2 to 32, 57 and 58)

Toners 2 to 32, 57 and 58 were obtained by similar methods except that the composition of the toner 1 was changed as shown in Table 8-1, Table 8-2 and Table 8-3. The physical properties of the toners 2 to 32, 57 and 58 are shown in Table 9.

TABLE 8-1

| | Master batch | | | | | | Toner particle composition | | | | | | | |
|---|---|---|---|---|---|---|---|---|---|---|---|---|---|---|
| | | | | | | | | Binder resin | | | | | | |
| | Styrene (parts) | Basic-treated pigment (parts) | | Pigment dispersant (parts) | | | Master batch (parts) | Styrene (parts) | Butyl acrylate (parts) | Fixing auxiliary agent (parts) | | Resin A (parts) | WAX (HNP-9) (parts) | Initiator (parts) |
| Toner 1 | 216 | Basic-treated pigment 1 | 36.0 | S1 | 3.60 | | 192 | 106 | 89.3 | Fixing auxiliary agent 1 | 22.5 | 13.5 | 27.0 | 28.6 |

TABLE 8-1-continued

| | Master batch | | | | | Toner particle composition | | | | | | | |
|---|---|---|---|---|---|---|---|---|---|---|---|---|---|
| | | | | | | | Binder resin | | Fixing | | | | |
| | Styrene (parts) | Basic-treated pigment (parts) | | Pigment dispersant (parts) | | Master batch (parts) | Styrene (parts) | Butyl acrylate (parts) | auxiliary agent (parts) | | Resin A (parts) | WAX (HNP-9) (parts) | Initiator (parts) |
| Toner 2 | 216 | Basic-treated pigment 1 | 36.0 | S1 | 3.60 | 192 | 106 | 89.3 | Fixing auxiliary agent 2 | 22.5 | 13.5 | 27.0 | 28.6 |
| Toner 3 | 216 | Basic-treated pigment 1 | 36.0 | S1 | 3.60 | 192 | 106 | 89.3 | Fixing auxiliary agent 3 | 22.5 | 13.5 | 27.0 | 28.6 |
| Toner 4 | 216 | Basic-treated pigment 1 | 36.0 | S1 | 3.60 | 192 | 106 | 89.3 | Fixing auxiliary agent 4 | 22.5 | 13.5 | 27.0 | 28.6 |
| Toner 5 | 216 | Basic-treated pigment 11 | 42.0 | S1 | 4.20 | 197 | 102 | 88.1 | Fixing auxiliary agent 3 | 22.5 | 13.5 | 27.0 | 28.2 |
| Toner 6 | 216 | Basic-treated pigment 12 | 48.0 | S1 | 4.80 | 202 | 99 | 86.9 | Fixing auxiliary agent 3 | 22.5 | 13.5 | 27.0 | 27.8 |
| Toner 7 | 216 | Basic-treated pigment 13 | 48.0 | S1 | 4.80 | 202 | 99 | 86.9 | Fixing auxiliary agent 3 | 22.5 | 13.5 | 27.0 | 27.8 |
| Toner 8 | 216 | Basic-treated pigment 1 | 36.0 | S2 | 3.60 | 192 | 106 | 89.3 | Fixing auxiliary agent 1 | 22.5 | 13.5 | 27.0 | 28.6 |
| Toner 9 | 216 | Basic-treated pigment 1 | 36.0 | S3 | 3.60 | 192 | 106 | 89.3 | Fixing auxiliary agent 1 | 22.5 | 13.5 | 27.0 | 28.6 |
| Toner 10 | 216 | Basic-treated pigment 1 | 36.0 | S4 | 3.60 | 192 | 106 | 89.3 | Fixing auxiliary agent 1 | 22.5 | 13.5 | 27.0 | 28.6 |
| Toner 11 | 216 | Basic-treated pigment 1 | 36.0 | S5 | 3.60 | 192 | 106 | 89.3 | Fixing auxiliary agent 1 | 22.5 | 13.5 | 27.0 | 28.6 |
| Toner 12 | 216 | Basic-treated pigment 1 | 36.0 | S7 | 3.60 | 192 | 106 | 89.3 | Fixing auxiliary agent 3 | 22.5 | 13.5 | 27.0 | 28.6 |

TABLE 8-2

| | Master batch | | | | | Toner particle composition | | | | | | | |
|---|---|---|---|---|---|---|---|---|---|---|---|---|---|
| | | | | | | | Binder resin | | Fixing | | | | |
| | Styrene (parts) | Basic-treated pigment (parts) | | Pigment dispersant (parts) | | Master batch (parts) | Styrene (parts) | Butyl acrylate (parts) | auxiliary agent (parts) | | Resin A (parts) | WAX (HNP-9) (parts) | Initiator (parts) |
| Toner 13 | 216 | Basic-treated pigment 1 | 36.0 | S8 | 3.60 | 192 | 106 | 89.3 | Fixing auxiliary agent 3 | 22.5 | 13.5 | 27.0 | 28.6 |
| Toner 14 | 216 | Basic-treated pigment 1 | 36.0 | S6 | 3.60 | 192 | 106 | 89.3 | Fixing auxiliary agent 3 | 22.5 | 13.5 | 27.0 | 28.6 |
| Toner 15 | 216 | Basic-treated pigment 1 | 36.0 | S9 | 3.60 | 192 | 106 | 89.3 | Fixing auxiliary agent 3 | 22.5 | 13.5 | 27.0 | 28.6 |
| Toner 16 | 216 | Basic-treated pigment 1 | 36.0 | S10 | 3.60 | 192 | 106 | 89.3 | Fixing auxiliary agent 3 | 22.5 | 13.5 | 27.0 | 28.6 |
| Toner 17 | 216 | Basic-treated pigment 1 | 36.0 | S11 | 3.60 | 192 | 106 | 89.3 | Fixing auxiliary agent 3 | 22.5 | 13.5 | 27.0 | 28.6 |
| Toner 18 | 216 | Basic-treated pigment 1 | 36.0 | S12 | 3.60 | 192 | 106 | 89.3 | Fixing auxiliary agent 3 | 22.5 | 13.5 | 27.0 | 28.6 |

TABLE 8-2-continued

| | Master batch | | | | | Toner particle composition | | | | | | | |
|---|---|---|---|---|---|---|---|---|---|---|---|---|---|
| | | | | | | | Binder resin | | Fixing | | | | |
| | Styrene (parts) | Basic-treated pigment (parts) | | Pigment dispersant (parts) | | Master batch (parts) | Styrene (parts) | Butyl acrylate (parts) | auxiliary agent (parts) | | Resin A (parts) | WAX (HNP-9) (parts) | Initiator (parts) |
| Toner 19 | 216 | Basic-treated pigment 1 | 36.0 | S13 | 3.60 | 192 | 106 | 89.3 | Fixing auxiliary agent 4 | 22.5 | 13.5 | 27.0 | 28.6 |
| Toner 20 | 216 | Basic-treated pigment 1 | 36.0 | S14 | 3.60 | 192 | 106 | 89.3 | Fixing auxiliary agent 4 | 22.5 | 13.5 | 27.0 | 28.6 |
| Toner 21 | 216 | Basic-treated pigment 1 | 36.0 | S15 | 3.60 | 192 | 106 | 89.3 | Fixing auxiliary agent 4 | 22.5 | 13.5 | 27.0 | 28.6 |
| Toner 22 | 216 | Basic-treated pigment 1 | 36.0 | S16 | 3.60 | 192 | 106 | 89.3 | Fixing auxiliary agent 4 | 22.5 | 13.5 | 27.0 | 28.6 |
| Toner 23 | 216 | Basic-treated pigment 2 | 36.0 | S1 | 3.60 | 192 | 106 | 89.3 | Fixing auxiliary agent 1 | 22.5 | 13.5 | 27.0 | 28.6 |
| Toner 24 | 216 | Basic-treated pigment 3 | 36.0 | S1 | 3.60 | 192 | 106 | 89.3 | Fixing auxiliary agent 1 | 22.5 | 13.5 | 27.0 | 28.6 |

TABLE 8-3

| | Master batch | | | | | Toner particle composition | | | | | | | |
|---|---|---|---|---|---|---|---|---|---|---|---|---|---|
| | | | | | | | Binder resin | | Fixing | | | | |
| | Styrene (parts) | Basic-treated pigment (parts) | | Pigment dispersant (parts) | | Master batch (parts) | Styrene (parts) | Butyl acrylate (parts) | auxiliary agent (parts) | | Resin A (parts) | WAX (HNP-9) (parts) | Initiator (parts) |
| Toner 25 | 216 | Basic-treated pigment 4 | 36.0 | S1 | 3.60 | 192 | 106 | 89.3 | Fixing auxiliary agent 1 | 22.5 | 13.5 | 27.0 | 28.6 |
| Toner 26 | 216 | Basic-treated pigment 5 | 36.0 | S1 | 3.60 | 192 | 106 | 89.3 | Fixing auxiliary agent 1 | 22.5 | 13.5 | 27.0 | 28.6 |
| Toner 27 | 216 | Basic-treated pigment 6 | 36.0 | S1 | 3.60 | 192 | 106 | 89.3 | Fixing auxiliary agent 1 | 22.5 | 13.5 | 27.0 | 28.6 |
| Toner 28 | 216 | Basic-treated pigment 14 | 36.0 | S1 | 3.60 | 192 | 106 | 89.3 | Fixing auxiliary agent 1 | 22.5 | 13.5 | 27.0 | 28.6 |
| Toner 29 | 216 | Basic-treated pigment 7 | 36.0 | S1 | 3.60 | 192 | 106 | 89.3 | Fixing auxiliary agent 1 | 22.5 | 13.5 | 27.0 | 28.6 |
| Toner 30 | 216 | Basic-treated pigment 8 | 36.0 | S1 | 3.60 | 192 | 106 | 89.3 | Fixing auxiliary agent 1 | 22.5 | 13.5 | 27.0 | 28.6 |
| Toner 31 | 216 | Basic-treated pigment 9 | 36.0 | S1 | 3.60 | 192 | 106 | 89.3 | Fixing auxiliary agent 1 | 22.5 | 13.5 | 27.0 | 28.6 |
| Toner 32 | 216 | Basic-treated pigment 10 | 36.0 | S1 | 3.60 | 192 | 106 | 89.3 | Fixing auxiliary agent 1 | 22.5 | 13.5 | 27.0 | 28.6 |
| Toner 57 | 216 | Basic-treated pigment 1 | 36.0 | — | 0.00 | 189 | 125 | 95.6 | — | 0.0 | 13.5 | 27.0 | 30.6 |
| Toner 58 | 216 | Basic-treated pigment 1 | 36.0 | S18 | 3.60 | 192 | 106 | 89.3 | Fixing auxiliary agent 1 | 22.5 | 13.5 | 27.0 | 28.6 |

DISPERBYK102 (copolymer having acidic group, acid value 101 mg KOH/g, BYK-Chemie GmbH) was used as S18 in Table 8-1, Table 8-2 and Table 8-3.

TABLE 9

| | TgA − TgB (° C.) | \| HP1 − HP2 \| | Fixing auxiliary agent/Total resin (%) | Pigment dispersant/ Fixing auxiliary agent (parts) | Toner particle diameter (μm) |
|---|---|---|---|---|---|
| Toner 1 | 8.4 | 0.09 | 5.9 | 12.0 | 6.2 |
| Toner 2 | 5.9 | 0.14 | 5.9 | 12.0 | 6.3 |
| Toner 3 | 16.9 | 0.07 | 5.9 | 12.0 | 6.2 |
| Toner 4 | 18.0 | 0.12 | 5.9 | 12.0 | 6.0 |
| Toner 5 | 16.9 | 0.07 | 6.0 | 14.0 | 6.3 |
| Toner 6 | 16.9 | 0.07 | 6.1 | 16.0 | 6.7 |
| Toner 7 | 16.9 | 0.07 | 6.1 | 16.0 | 6.8 |
| Toner 8 | 8.4 | 0.22 | 5.9 | 12.0 | 6.2 |
| Toner 9 | 8.4 | 0.13 | 5.9 | 12.0 | 6.0 |
| Toner 10 | 8.4 | 0.01 | 5.9 | 12.0 | 6.1 |
| Toner 11 | 8.4 | 0.03 | 5.9 | 12.0 | 6.0 |
| Toner 12 | 16.9 | 0.04 | 5.9 | 12.0 | 6.2 |
| Toner 13 | 16.9 | 0.03 | 5.9 | 12.0 | 6.5 |
| Toner 14 | 16.9 | 0.07 | 5.9 | 12.0 | 6.3 |
| Toner 15 | 16.9 | 0.07 | 5.9 | 12.0 | 5.9 |
| Toner 16 | 16.9 | 0.09 | 5.9 | 12.0 | 6.0 |
| Toner 17 | 16.9 | 0.07 | 5.9 | 12.0 | 6.2 |
| Toner 18 | 16.9 | 0.09 | 5.9 | 12.0 | 6.2 |
| Toner 19 | 18.0 | 0.13 | 5.9 | 12.0 | 6.1 |
| Toner 20 | 18.0 | 0.12 | 5.9 | 12.0 | 6.3 |
| Toner 21 | 18.0 | 0.12 | 5.9 | 12.0 | 6.1 |
| Toner 22 | 18.0 | 0.13 | 5.9 | 12.0 | 6.7 |
| Toner 23 | 8.4 | 0.09 | 5.9 | 12.0 | 6.4 |
| Toner 24 | 8.4 | 0.09 | 5.9 | 12.0 | 6.1 |
| Toner 25 | 8.4 | 0.09 | 5.9 | 12.0 | 6.1 |
| Toner 26 | 8.4 | 0.09 | 5.9 | 12.0 | 6.5 |
| Toner 27 | 8.4 | 0.09 | 5.9 | 12.0 | 6.3 |
| Toner 28 | 8.4 | 0.09 | 5.9 | 12.0 | 6.8 |
| Toner 29 | 8.4 | 0.09 | 5.9 | 12.0 | 6.5 |
| Toner 30 | 8.4 | 0.09 | 5.9 | 12.0 | 6.5 |
| Toner 31 | 8.4 | 0.09 | 5.9 | 12.0 | 6.4 |
| Toner 32 | 8.4 | 0.09 | 5.9 | 12.0 | 6.5 |
| Toner 57 | — | — | 0.0 | — | 6.7 |
| Toner 58 | 8.4 | 0.62 | 5.9 | 12.0 | 6.5 |

In the Table, "Fixing auxiliary agent/Total resin (%)" shows the content of the fixing auxiliary agent as a percentage of the total of the binder resin and the fixing auxiliary agent. "Pigment dispersant/Fixing auxiliary agent (parts)" shows the mass parts of the pigment dispersant (resin having acidic functional group) per 100 mass parts of the fixing auxiliary agent.

(Manufacture of Toner 33)

(Preparation of Master Batch Dispersion 2)

| | |
|---|---|
| Methylethylketone | 144 parts |
| Basic-treated pigment 1 | 36.0 parts |
| Resin S1 having acidic functional group | 3.60 parts |

These materials were introduced into an attritor, and stirred for 180 minutes at 250 rpm, 25° C. with 180 parts of zirconia beads having a radius of 2.5 mm, to prepare a master batch dispersion 2.

(Preparation of Toner Composition Solution 2)

| | |
|---|---|
| Master batch dispersion 2 | 96.4 parts |
| Methylethylketone | 59.4 parts |
| Resin P1 | 253 parts |
| Hydrocarbon wax (HNP-9, Nippon Seiro Co., Ltd.) | 15.8 parts |
| Resin A | 9.45 parts |
| Fixing auxiliary agent 5 | 15.8 parts |

These materials were mixed and heated to 75° C., and dissolved and dispersed for 60 minutes at 5,000 rpm with a T.K. Homomixer to obtain a toner composition solution 2.

1000 parts of ion-exchange water and 480 parts of 0.1 mol/L aqueous $Na_3PO_4$ solution were added to a 2-liter four-necked flask equipped with a T.K. Homomixer, and heated to 60° C. with the T.K. Homomixer adjusted to 10,000 rpm. 71.9 parts of 1.0 mol/L aqueous $CaCl_2$ solution and 3.90 parts of 10% hydrochloric acid were then added gradually to obtain an aqueous medium containing a calcium phosphate compound.

Next, the toner composition solution 2 was added to this aqueous medium. This was stirred for 30 minutes at 13,000 rpm with a T.K. Homomixer at 75° C. to granulate the toner composition solution. This was then heated to 85° C. while being stirred with a paddle stirring blade, and distilled for 5 hours under normal pressure. The residual solvent was then further removed under reduced pressure, and the aqueous medium was cooled to obtain a toner particle dispersion.

Hydrochloric acid was added to lower the pH of the toner particle dispersion to 1.4, and the dispersion was stirred for 1 hour to dissolve the calcium phosphate salt. This was then subjected to solid-liquid separation under 0.4 Mpa of pressure in a pressure filtration unit, to obtain a toner cake. Ion-exchange water was then added until the pressure filter unit was full, and the cake was washed under 0.4 Mpa of pressure. This washing operation was repeated three times, and the product was dried to obtain a toner particle 33.

The same external additive added to the toner particle 1 was then added to the toner particle 33 to obtain a toner 33.

(Manufacture of Toners 34 to 50 and 53 to 56)

Toners 34 to 50 and 53 to 56 were obtained by the same methods except that the composition of the toner 33 was changed as shown in Table 10-1 and Table 10-2. The physical properties are shown in Table 10-1 and Table 10-2.

TABLE 10-1

| | Master batch | | | | | Toner particle composition | | | | | | |
|---|---|---|---|---|---|---|---|---|---|---|---|---|
| | Methylethylketone (parts) | Basic-treated pigment (parts) | | Pigment dispersant (parts) | | Methylethylketone (parts) | Master batch (parts) | Resin (parts) | | Fixing auxiliary agent (parts) | Resin A (parts) | WAX (HNP-9) (parts) |
| Toner 33 | 144 | Basic-treated pigment 1 | 36.0 | S1 | 3.60 | 59.4 | 96.4 | P1 | 253 | Fixing auxiliary agent 5 15.8 | 9.45 | 15.8 |

TABLE 10-1-continued

| | Master batch | | | | | Toner particle composition | | | | | | | |
|---|---|---|---|---|---|---|---|---|---|---|---|---|---|
| | Methylethyl-ketone (parts) | Basic-treated pigment (parts) | | Pigment dispersant (parts) | | Methylethyl-ketone (parts) | Master batch (parts) | Resin (parts) | | Fixing auxiliary agent (parts) | | Resin A (parts) | WAX (HNP-9) (parts) |
| Toner 34 | 144 | Basic-treated pigment 1 | 36.0 | S1 | 3.60 | 59.4 | 94.7 | P1 | 255 | Fixing auxiliary agent 5 | 15.8 | 9.45 | 15.8 |
| Toner 35 | 144 | Basic-treated pigment 1 | 36.0 | S1 | 1.80 | 59.4 | 95.4 | P1 | 254 | Fixing auxiliary agent 5 | 15.8 | 9.45 | 15.8 |
| Toner 36 | 144 | Basic-treated pigment 1 | 36.0 | S1 | 9.00 | 59.4 | 99.2 | P1 | 235 | Fixing auxiliary agent 5 | 31.5 | 9.45 | 15.8 |
| Toner 37 | 144 | Basic-treated pigment 1 | 36.0 | S1 | 14.40 | 59.4 | 102.1 | P1 | 232 | Fixing auxiliary agent 5 | 31.5 | 9.45 | 15.8 |
| Toner 38 | 144 | Basic-treated pigment 1 | 36.0 | S1 | 3.60 | 59.4 | 96.4 | P1 | 264 | Fixing auxiliary agent 1 | 4.73 | 9.45 | 15.8 |
| Toner 39 | 144 | Basic-treated pigment 1 | 36.0 | S1 | 3.60 | 59.4 | 96.4 | P1 | 260 | Fixing auxiliary agent 1 | 9.5 | 9.45 | 15.8 |
| Toner 40 | 144 | Basic-treated pigment 1 | 36.0 | S1 | 3.60 | 59.4 | 96.4 | P1 | 238 | Fixing auxiliary agent 1 | 31.5 | 9.45 | 15.8 |
| Toner 41 | 144 | Basic-treated pigment 1 | 36.0 | S1 | 3.60 | 59.4 | 96.4 | P1 | 206 | Fixing auxiliary agent 1 | 63.0 | 9.45 | 15.8 |
| Toner 42 | 144 | Basic-treated pigment 1 | 36.0 | S1 | 3.60 | 59.4 | 96.4 | P1 | 253 | Fixing auxiliary agent 6 | 15.8 | 9.45 | 15.8 |
| Toner 43 | 144 | Basic-treated pigment 1 | 36.0 | S1 | 3.60 | 59.4 | 96.4 | P2 | 253 | Fixing auxiliary agent 7 | 15.8 | 9.45 | 15.8 |

TABLE 10-2

| | Master batch | | | | | Toner particle composition | | | | | | | |
|---|---|---|---|---|---|---|---|---|---|---|---|---|---|
| | Methylethyl-ketone (parts) | Basic-treated pigment (parts) | | Pigment dispersant (parts) | | Methylethyl-ketone (parts) | Master batch (parts) | Resin (parts) | | Fixing auxiliary agent (parts) | | Resin A (parts) | WAX (HNP-9) (parts) |
| Toner 44 | 144 | Basic-treated pigment 1 | 36.0 | S1 | 3.60 | 59.4 | 96.4 | P2 | 253 | Fixing auxiliary agent 8 | 15.8 | 9.45 | 15.8 |
| Toner 45 | 144 | Basic-treated pigment 1 | 36.0 | S1 | 3.60 | 59.4 | 96.4 | P2 | 253 | Fixing auxiliary agent 9 | 15.8 | 9.45 | 15.8 |
| Toner 46 | 144 | Basic-treated pigment 1 | 36.0 | S1 | 3.60 | 59.4 | 96.4 | P2 | 253 | Fixing auxiliary agent 10 | 15.8 | 9.45 | 15.8 |
| Toner 47 | 144 | Basic-treated pigment 1 | 36.0 | S1 | 3.60 | 59.4 | 96.4 | P2 | 253 | Fixing auxiliary agent 11 | 15.8 | 9.45 | 15.8 |
| Toner 48 | 144 | Basic-treated pigment 1 | 36.0 | S1 | 3.60 | 59.4 | 96.4 | P2 | 253 | Fixing auxiliary agent 12 | 15.8 | 9.45 | 15.8 |
| Toner 49 | 144 | Basic-treated pigment 1 | 36.0 | S1 | 3.60 | 59.4 | 96.4 | P2 | 253 | Fixing auxiliary agent 13 | 15.8 | 9.45 | 15.8 |
| Toner 50 | 144 | Basic-treated pigment 1 | 36.0 | S1 | 3.60 | 59.4 | 96.4 | P2 | 253 | Fixing auxiliary agent 14 | 15.8 | 9.45 | 15.8 |
| Toner 53 | 144 | Basic-treated pigment 1 | 36.0 | S17 | 3.60 | 59.4 | 96.4 | P2 | 253 | Fixing auxiliary agent 1 | 15.8 | 9.45 | 15.8 |

TABLE 10-2-continued

| | Master batch | | | | | Toner particle composition | | | | | | | |
|---|---|---|---|---|---|---|---|---|---|---|---|---|---|
| | Methylethyl-ketone (parts) | Basic-treated pigment (parts) | | Pigment dispersant (parts) | | Methylethyl-ketone (parts) | Master batch (parts) | Resin (parts) | | Fixing auxiliary agent (parts) | | Resin A (parts) | WAX (HNP-9) (parts) |
| Toner 54 | 144 | Basic-treated pigment 1 | 36.0 | S1 | 3.60 | 59.4 | 96.4 | P2 | 253 | Fixing auxiliary agent 15 | 15.8 | 9.45 | 15.8 |
| Toner 55 | 144 | PB15:3 | 36.0 | — | 0.00 | 59.4 | 94.5 | P2 | 255 | Fixing auxiliary agent 1 | 15.8 | 9.45 | 15.8 |
| Toner 56 | 144 | Basic-treated pigment 1 | 36.0 | — | 0.00 | 59.4 | 94.5 | P2 | 255 | Fixing auxiliary agent 1 | 15.8 | 9.45 | 15.8 |

TABLE 11

| | TgA − TgB (° C.) | \| HP1 − HP2 \| | Fixing auxiliary agent/Total resin (%) | Resin dispersant/ fixing aux-iliary agent (parts) | Toner particle diameter (μm) |
|---|---|---|---|---|---|
| Toner 33 | 10.9 | 0.12 | 5.9 | 12.0 | 6.2 |
| Toner 34 | 10.9 | 0.12 | 5.8 | 1.2 | 6.5 |
| Toner 35 | 10.9 | 0.12 | 5.8 | 6.0 | 6.3 |
| Toner 36 | 10.9 | 0.12 | 11.8 | 15.0 | 6.3 |
| Toner 37 | 10.9 | 0.12 | 12.0 | 24.0 | 6.6 |
| Toner 38 | 8.4 | 0.09 | 1.8 | 40.0 | 6.1 |
| Toner 39 | 8.4 | 0.09 | 3.5 | 20.0 | 6.5 |
| Toner 40 | 8.4 | 0.09 | 11.7 | 6.0 | 6.6 |
| Toner 41 | 8.4 | 0.09 | 23.4 | 3.0 | 6.8 |
| Toner 42 | 11.9 | 0.04 | 5.9 | 12.0 | 6.2 |
| Toner 43 | 9.4 | 0.08 | 5.9 | 12.0 | 6.5 |
| Toner 44 | 5.9 | 0.15 | 5.9 | 12.0 | 6.3 |
| Toner 45 | 7.9 | 0.14 | 5.9 | 12.0 | 6.2 |
| Toner 46 | 7.9 | 0.14 | 5.9 | 12.0 | 6.0 |
| Toner 47 | 7.9 | 0.14 | 5.9 | 12.0 | 6.1 |
| Toner 48 | 7.9 | 0.14 | 5.9 | 12.0 | 6.5 |
| Toner 49 | 21.0 | 0.01 | 5.9 | 12.0 | 6.4 |
| Toner 50 | 19.0 | 0.05 | 5.9 | 12.0 | 6.2 |
| Toner 53 | 8.4 | 0.43 | 5.9 | 12.0 | 6.2 |
| Toner 54 | 2.9 | 0.18 | 5.9 | 12.0 | 6.1 |
| Toner 55 | 8.4 | — | 5.8 | — | 6.4 |
| Toner 56 | 8.4 | — | 5.8 | — | 6.8 |

(Manufacture of Toner 51)

(Preparation of Master Batch Dispersion 3)

| | |
|---|---|
| Methylethylketone | 120 parts |
| Basic-treated pigment 1 | 30.0 parts |
| Resin S1 having acidic functional group | 3.00 parts |

These materials were introduced into an attritor, and stirred for 180 minutes at 250 rpm, 25° C. with 180 parts of zirconia beads having a radius of 2.5 mm, to prepare a master batch dispersion 3.

115 parts of the resin P2 was loaded into a twin-screw kneader (PCM-30, Ikegai Corp.) set to 120° C., and 143.7 parts of the master batch dispersion 3 were added in three additions and kneaded to remove the solvent. Next, the following materials were added and kneaded.

| | |
|---|---|
| Resin P2 | 268 parts |
| Hydrocarbon wax (HNP-9, Nippon Seiro Co., Ltd.) | 18.8 parts |

-continued

| | |
|---|---|
| Resin A | 14.1 parts |
| Fixing auxiliary agent 5 | 23.5 parts |

The resulting kneaded product was cooled, and coarsely crushed to 1 mm or less in a hammer mill to obtain a coarsely crushed material. The resulting coarsely crushed material was then pulverized with a mechanical pulverizer (T-250, Turbo Kogyo Co., Ltd.). It was then classified with a rotary classifier (200 TSP, Hosokawa Micron Corporation) to obtain a toner particle 51. For the operating conditions of the rotary classifier (200 TSP, Hosokawa Micron Corporation), the classification rotor speed was 50.0 $s^{-1}$.

An external additive was added to the toner particle 51 under the same conditions as in toner particle 1, to obtain a toner 51. The physical properties of the toner 51 are shown in Table 12.

(Manufacture of Toner 52)

(Preparation of Colorant Particle Dispersion 1)

| | |
|---|---|
| Methylethylketone | 240.0 parts |
| Basic-treated pigment 1 | 60.0 parts |
| Resin S1having acidic functional group | 6.00 parts |

These materials were introduced into an attritor, and stirred for 180 minutes at 250 rpm, 25° C. with 180 parts of zirconia beads with a radius of 2.5 mm, to prepare a master batch dispersion 4.

3.00 parts of an anionic surfactant (Neogen R, DKS Co. Ltd.) were mixed and dissolved in 250.0 parts of ion-exchange water. The master batch dispersion 4 was then added dropwise as the mixture was emulsified and dispersed with a homogenizer (IKA (Trademark) Werke GmbH & Co. KG, Ultra-Turrax), and dispersion was continued for 10 minutes after the entire quantity had been added. The solvent was distilled off from the resulting dispersion at room temperature under reduced pressure until the solid content was 25%, and the mixture was dispersed for 30 minutes with an ultrasound bath to obtain a colorant particle dispersion 1 with a solid content of 25% and a center diameter of 200 nm.

(Manufacturing Example of Resin Particle Dispersion 1)

| | |
|---|---|
| Methylethylketone | 200 parts |
| Resin P2 | 280 parts |
| Fixing auxiliary agent 1 | 15.0 parts |

These materials were placed in reactor equipped with a stirrer, and dissolved and mixed for 60 minutes at 70° C. to obtain a resin solution 1. An aqueous neutralizing solution was then prepared by dissolving 5.60 parts of sodium dodecylbenzensulfonate and 3.00 parts of 1 N NaOH aqueous solution in 1200 parts of ion-exchange water that had been heated to 95° C. This aqueous neutralizing solution was added to the flask containing the resin solution 1, and emulsified for 5 minutes with a homogenizer (Ultra-Turrax). The solvent was distilled off from this dispersion at 60° C. under reduced pressure until the solid content was 20%, after which the mixture was dispersed for 30 minutes with an ultrasound bath, and the flask was cooled with room-temperature (25° C.) water, resulting in a resin particle dispersion 1 with a solid content of 20 mass % and a median diameter of 250 nm of the resin particle.

(Manufacturing Example of Release Agent Particle Dispersion 1)

| | |
|---|---|
| Anionic surfactant (Neogen R, DKS Co. Ltd.) | 0.80 parts |
| Ion-exchange water | 350 parts |
| Hydrocarbon wax (HNP-9, Nippon Seiro Co., Ltd.) | 40.0 parts |

These components were mixed, heated to 120° C., and dispersed with a pressure discharge type Gaulin homogenizer to obtain a 25 mass % release agent particle dispersion 1 with a volume-average particle diameter of 170 nm.

(Manufacturing Example of Resin Particle Dispersion 2)

| | |
|---|---|
| Methylethylketone | 108 parts |
| Resin P2 | 54.0 parts |

These materials were placed in a reactor equipped with a stirrer, and dissolved and mixed for 60 minutes at 70° C. to obtain a resin solution 2. An aqueous neutralizing solution was prepared by dissolving of 1.08 parts of sodium dodecylbenzensulfonate and 3.00 parts of 1N NaOH aqueous solution in 238 parts of ion-exchange water that had been heated to 95° C. This aqueous neutralizing solution was added to the flask containing the resin solution 2, and emulsified for 5 minutes with a homogenizer (Ultra-Turrax). The solvent was distilled off from this dispersion at 60° C. under reduced pressure until the solid content was 20%, after which the mixture was dispersed for 30 minutes with an ultrasound bath, and the flask was cooled with room-temperature (25° C.) water, resulting in a resin particle dispersion 2 with a solid content of 20 mass % and a median diameter of 250 nm of the resin particle.

(Preparation of Toner Particle 52)

| | |
|---|---|
| Resin particle dispersion 1 | 1868 parts |
| Colorant particle dispersion 1 | 106 parts |
| Anionic surfactant | 25.0 parts |

(Dowfax2A1 20% Aqueous Solution)

Release Agent Particle Dispersion 1 64.0 Parts

Out of these raw materials, the resin particle dispersion 1, the anionic surfactant and 250 parts of ion-exchange water were added first to a polymerization kettle equipped with a pH meter, a stirrer and a thermometer, and stirred for 15 minutes at 130 rpm as the surfactant was blended with the resin particle dispersion. The colorant particle dispersion 1 and release agent dispersion 1 were then added and mixed, after which a 0.3 mol/L aqueous nitric acid solution was added to this raw material mixture to adjust the pH to 4.8. Shearing force was then applied at 3000 rpm with an Ultra-Turrax as 20.0 parts of a 10% aqueous nitric acid solution of aluminum sulfate were added dropwise as a flocculant. Because the viscosity of the raw material mixture increases as the flocculant is added, the drop speed was reduced once the viscosity started to rise so that the flocculant would not become localized in one part of the mixture. Once all of the flocculant had been added, the mixture was stirred for a further 5 minutes with the rotational speed increased to 5,000 rpm, to thoroughly mix the flocculant with the raw material mixture.

Next, the raw material mixture was stirred at 500 rpm while being heated to 25° C. with a mantle heater. Once formation of primary particles had been confirmed, the temperature was raised to 43° C. at 0.1° C./minute to cause growth of aggregated particles. The growth of the aggregated particles was confirmed as needed, and the aggregation temperature and rotational rate of stirring were changed depending on the rate of aggregation.

Meanwhile, 60.0 parts of ion-exchange water and 5.50 parts of an anionic surfactant (Dowfax2A1 20% aqueous solution) were added and mixed with 60.0 parts of the resin particle dispersion 2 for purposes of coating the aggregated particles. The pH of this mixture was adjusted to 3.8 to obtain a coating resin particle dispersion. Once the aggregated particles had grown to 5.2 μm in the aggregation step, the coating resin particle dispersion was added, and maintained with stirring for 20 minutes. A 1 mol/L sodium hydroxide aqueous solution was then added to stop the growth of the coated aggregated particles, and the pH of the raw material mixture was controlled at 7.6. The temperature of the mixture was then raised to 85° C. at a rate of 1° C./minute with the pH adjusted to 7.6 to fuse the aggregated particles. Once 85° C. was reached, the pH was adjusted to 7.6 or less to promote fusion, and fusion of the aggregated particles was confirmed under an optical microscope, after which ice water was poured in to quickly cool the mixture at 10° C./minute and stop particle growth.

This was then sieved once with a 15 μm mesh to wash the resulting particle. Ion exchange water (30° C.) in about 10 times the amount of the solid component was added and stirred for 20 minutes, and the mixture was immediately filtered. The solids remaining on the filter paper were also dispersed in the slurry, washed 4 times with 30° C. ion-exchange water, and dried to obtain a toner particle 52.

As in the case of the toner particle 1, an external additive was added to the toner particle 52 to obtain a toner 52. The physical properties of the toner 52 are shown in Table 12.

TABLE 12

| | TgA − TgB (° C.) | \| HP1 − HP2 \| | Fixing auxiliary agent/Total resin (%) | Pigment dispersant/ Fixing auxiliary agent (parts) | Toner particle diameter (μm) |
|---|---|---|---|---|---|
| Toner 51 | 8.4 | 0.09 | 6.2 | 12.8 | 6.0 |
| Toner 52 | 8.4 | 0.09 | 5.4 | 12.0 | 6.5 |

Examples 1 to 52 and Comparative Examples 1 to 6

Toners 1 to 58 were evaluated as follows.

(Tinting Strength Evaluation)

The original toner was removed from a cartridge for a Satera LBP7700C commercial color laser printer (Canon Inc.), the interior was cleaned by air blowing, and the cartridge was filled with a toner (150 g).

The fixing mechanism was also removed from the color laser printer, which was modified to allow it to output unfixed images, and so that the image density could be adjusted. It was also modified so that it operated even when only a single color cartridge was installed. The removed fixing mechanism was modified so that it could operate independently, and to allow the process speed and temperature to be controlled, to obtain an external fixing unit.

The cartridge was mounted in the printer, and a 30 mm white area was created on the upper part of a transfer material above a band image 150 mm in width and 30 mm in height. The controller was set so that the toner laid-on level of the band image was 0.35 mg/cm$^2$. A4 size GF-C081 (Canon Inc., 81.4 g/m$^2$) was used as the transfer material.

10 copies of this band image were output, and fixed at 150° C. at a process speed of 240 mm/sec with the external fixing mechanism of the LBP7700C color laser printer.

The image density of the resulting fixed images was measured to evaluate tinting strength.

The image density was measured using an RD918 Macbeth reflection densitometer (GretagMacbeth GmbH). Relative density was measured relative to the white background part of the printout image, which had a manuscript density of 0.00, at three points on the left, center and right of each fixed image, and the calculated average of 10 fixed images was evaluated. The evaluation standard was as follows. A score of C or greater means a level at which the effect of the present invention is obtained. The evaluation results are shown in Table 13-1, Table 13-2 and Table 13-3.

A: Image density 1.40 or more

B: Image density at least 1.35 and less than 1.40

C: Image density at least 1.30 and less than 1.35

D: Image density at least 1.25 and less than 1.30

E: Image density less than 1.25

(Low-Temperature Fixability Evaluation)

The toner contained in a cartridge of a commercial color laser printer (HP Color LaserJet 3525dn, HP Inc.) was removed, the interior of the cartridge was cleaned by air blowing, and the cartridge was filled with a toner (150 g).

The fixing mechanism was also removed from this color laser printer, which was modified so that it could output unfixed images. The removed fixing mechanism was modified so that it could operate independently, and so that the process speed and temperature could be controlled, to obtain an external fixing unit.

The cartridge was mounted in the printer, and a 30 mm white area was created on the upper part of a transfer material above a band image 150 mm in width and 20 mm in height. The toner laid-on level of the band image was set to 0.90 mg/cm$^2$, and A4 size CS-680 paper (Canon Inc., 68 g/m$^2$) was used as the transfer material.

In a normal-temperature, normal humidity environment (23° C., 60% RH), with the process speed set to 240 mm/s, the unfixed image was fixed at temperatures between 100° C. and 160° C. in 5° C. increments, and the low-temperature fixing initiation temperature was determined. The low-temperature fixing initiation temperature is the lowest temperature at which cold offset does not occur.

The evaluation standard is as follows, with a score of B or greater indicating a level at which the effect of the present invention is obtained. The results are shown in Table 13-1, Table 13-2 and Table 13-3.

A: Low-temperature fixing initiation temperature not more than 120° C.

B: Low-temperature fixing initiation temperature 125° C. or 130° C.

C: Low-temperature fixing initiation temperature 135° C. or 140° C.

D: Low-temperature fixing initiation temperature at least 145° C.

(Heat-Resistant Storability Evaluation)

5 g of toner were taken in a 50 mL resin cup, and left in either a 50° C./10% RH environment or a 55° C./10% RH environment for 72 hours. The presence or absence of toner clumps in the resulting toner was evaluated. The evaluation standard was as follows, with a score of C or greater indicated a level at which the effect of the present invention is obtained. The evaluation results are shown in Table 13-1, Table 13-2 and Table 13-3.

A: No clumps

B: Minor clumps that break up when pushed lightly with the fingers

C: Clumps that break up when pushed lightly with the fingers

D: Complete clumping, clumps do not break up when pushed strongly with the fingers

TABLE 13-1

| | | | Tinting strength | | Low-temperature | | Heat-resistant | |
|---|---|---|---|---|---|---|---|---|
| | | Toner | Value | Rank | Value | Rank | 50° C. | 55° C. |
| Example | 1 | Toner 1 | 1.45 | A | 120 | A | A | A |
| | 2 | Toner 2 | 1.44 | A | 120 | A | A | B |
| | 3 | Toner 3 | 1.45 | A | 115 | A | A | A |
| | 4 | Toner 4 | 1.44 | A | 120 | A | A | A |
| | 5 | Toner 5 | 1.46 | A | 115 | A | A | A |
| | 6 | Toner 6 | 1.37 | B | 115 | A | A | A |
| | 7 | Toner 7 | 1.38 | B | 115 | A | A | A |
| | 8 | Toner 8 | 1.37 | B | 125 | B | B | B |
| | 9 | Toner 9 | 1.39 | B | 120 | A | A | B |
| | 10 | Toner 10 | 1.41 | A | 120 | A | A | A |
| | 11 | Toner 11 | 1.39 | B | 120 | A | A | A |
| | 12 | Toner 12 | 1.43 | A | 115 | A | A | A |
| | 13 | Toner 13 | 1.44 | A | 115 | A | A | A |
| | 14 | Toner 14 | 1.38 | B | 115 | A | A | A |
| | 15 | Toner 15 | 1.40 | A | 115 | A | A | A |
| | 16 | Toner 16 | 1.36 | B | 120 | A | A | A |
| | 17 | Toner 17 | 1.34 | C | 125 | B | A | B |
| | 18 | Toner 18 | 1.30 | C | 125 | B | A | B |
| | 19 | Toner 19 | 1.38 | B | 120 | A | A | A |
| | 20 | Toner 20 | 1.43 | A | 120 | A | A | A |
| | 21 | Toner 21 | 1.42 | A | 120 | A | A | A |
| | 22 | Toner 22 | 1.40 | A | 120 | A | A | A |
| | 23 | Toner 23 | 1.40 | A | 120 | A | A | A |
| | 24 | Toner 24 | 1.43 | A | 120 | A | A | A |
| | 25 | Toner 25 | 1.45 | A | 120 | A | A | A |
| | 26 | Toner 26 | 1.40 | A | 120 | A | A | A |

TABLE 13-2

| | | Toner | Tinting strength | | Low-temperature | | Heat-resistant | |
|---|---|---|---|---|---|---|---|---|
| | | | Value | Rank | Value | Rank | 50° C. | 55° C. |
| Example | 27 | Toner 27 | 1.35 | B | 120 | A | A | A |
| | 28 | Toner 28 | 1.44 | A | 120 | A | A | A |
| | 29 | Toner 29 | 1.35 | B | 125 | B | A | B |
| | 30 | Toner 30 | 1.41 | A | 120 | A | A | A |
| | 31 | Toner 31 | 1.42 | A | 120 | A | A | A |
| | 32 | Toner 32 | 1.46 | A | 120 | A | B | B |
| | 33 | Toner 33 | 1.42 | A | 115 | A | A | A |
| | 34 | Toner 34 | 1.38 | B | 115 | A | A | B |
| | 35 | Toner 35 | 1.41 | A | 115 | A | A | A |
| | 36 | Toner 36 | 1.45 | A | 110 | A | A | A |
| | 37 | Toner 37 | 1.45 | A | 115 | A | A | B |
| | 38 | Toner 38 | 1.41 | A | 130 | B | A | A |
| | 39 | Toner 39 | 1.43 | A | 125 | B | A | A |
| | 40 | Toner 40 | 1.43 | A | 115 | A | A | A |
| | 41 | Toner 41 | 1.40 | A | 110 | A | B | B |
| | 42 | Toner 42 | 1.42 | A | 115 | A | B | B |
| | 43 | Toner 43 | 1.43 | A | 115 | A | A | B |
| | 44 | Toner 44 | 1.43 | A | 125 | B | A | B |
| | 45 | Toner 45 | 1.42 | A | 115 | A | B | B |
| | 46 | Toner 46 | 1.43 | A | 115 | A | A | B |
| | 47 | Toner 47 | 1.42 | A | 120 | A | A | B |
| | 48 | Toner 48 | 1.42 | A | 125 | B | A | B |
| | 49 | Toner 49 | 1.43 | A | 120 | A | A | A |
| | 50 | Toner 50 | 1.41 | A | 120 | A | B | C |
| | 51 | Toner 51 | 1.45 | A | 110 | A | B | C |
| | 52 | Toner 52 | 1.45 | A | 110 | A | B | C |

TABLE 13-3

| | | Toner | Tinting strength | | Low-temperature | | Heat-resistant | |
|---|---|---|---|---|---|---|---|---|
| | | | Value | Rank | Value | Rank | 50° C. | 55° C. |
| Comparative Example | 1 | Toner 53 | 1.27 | D | 130 | B | B | C |
| | 2 | Toner 54 | 1.40 | A | 140 | C | B | B |
| | 3 | Toner 55 | 1.18 | E | 130 | B | B | C |
| | 4 | Toner 56 | 1.28 | D | 130 | B | B | C |
| | 5 | Toner 57 | 1.28 | D | 150 | D | A | A |
| | 6 | Toner 58 | 1.19 | E | 130 | B | C | D |

While the present invention has been described with reference to exemplary embodiments, it is to be understood that the present invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-055223, filed Mar. 18, 2016, which is hereby incorporated by reference herein in its entirety.

What is claimed is:

1. A toner comprising a toner particle containing a binder resin, a pigment, a resin having an acidic functional group, and a fixing auxiliary agent, wherein the pigment is a pigment having a structure derived from a basic compound;

the binder resin and the fixing auxiliary agent satisfy following Formula (1):

$$(TgA-TgB)\geq 5.0^\circ\ C. \qquad \text{Formula (1)}$$

where

TgA represents a glass transition temperature (Tg) in differential scanning colorimetry of the binder resin, and TgB represents a Tg in differential scanning colorimetry of a resin mixture obtained by mixing the binder resin and the fixing auxiliary agent at a mass ratio of 9:1; and the resin having an acidic functional group has a hydrophobic parameter HP1 of at least 0.60, the fixing auxiliary agent has a hydrophobic parameter HP2, and the HP1 and the HP2 satisfy following Formula (2):

$$|HP1-HP2|\leq 0.30 \qquad \text{Formula (2)}$$

where HP1 represents a volume fraction of heptane at a point of precipitation by the resin having an acidic functional group as measured by the addition of heptane to a solution containing 0.01 mass parts of the resin having an acidic functional group and 1.48 mass parts of chloroform, and HP2 represents a volume fraction of heptane at a point of precipitation by the fixing auxiliary agent as measured by the addition of heptane to a solution containing 0.01 mass parts of the fixing auxiliary agent and 1.48 mass parts of chloroform.

2. The toner according to claim 1, wherein the acidic functional group of the resin is a carboxy group or a sulfo group.

3. The toner according to claim 1, wherein an acid value of the resin having an acidic functional group is at least 3.0 mg KOH/g and not more than 25.0 mg KOH/g.

4. The toner according to claim 1, wherein the HP1 is at least 0.75.

5. The toner according to claim 1, wherein pKa of the pigment is at least 4.0 and not more than 7.0 where the pKa is a base dissociation constant measured by preparing a pigment dispersion in which 10.0 mass parts of the pigment, 140.0 mass parts of toluene and 60.0 mass parts of ethanol are mixed, and carrying out neutralization titration with a 0.1 mol/L hydrochloric acid ethanol solution.

6. The toner according to claim 1, wherein the pigment having a structure derived from a basic compound is a pigment containing an organic dye having basic segments, and the organic dye having basic segments has a structure represented by Formula (3) below:

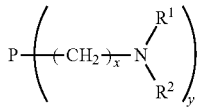

(3)

where P is an organic dye, x is 1 or 2, y is a value of at least 1 and not more than 4, and each of $R^1$ and $R^2$ independently represents a hydrogen atom or linear or branched alkyl group, or a group needed for forming a heterocycle in which $R^1$ and $R^2$ bind together.

7. The toner according to claim 6, wherein the P is an organic dye having a phthalocyanine skeleton or a quinacridone skeleton.

8. The toner according to claim 1, wherein the pigment having a structure derived from a basic compound is a pigment having a basic functional group, and the basic functional group is a group represented by Formula (3-1) below:

(3-1)

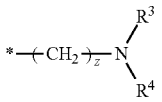

where * represents a segment binding to the pigment, z is 1 or 2, and each of $R^3$ and $R^4$ independently represents a hydrogen atom or linear or branched alkyl group, or a group needed for forming a heterocycle in which $R^3$ and $R^4$ binding together.

9. The toner according to claim 1, wherein a base value of the pigment is at least 0.9 mg KOH/g and not more than 3.0 mg KOH/g.

10. The toner according to claim 1, wherein the resin having an acidic functional group has a structure represented by Formula (4) below:

(4)

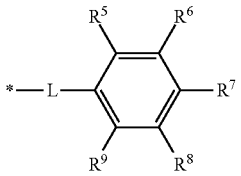

where one of $R^6$ and $R^7$ is a carboxy group, while each of $R^5$, $R^6$, $R^7$, $R^8$ and $R^9$ other than the carboxy group is independently a hydrogen atom, hydroxy group, amino group, $C_{1-8}$ alkyl group or $C_{1-8}$ alkoxy group, L is a linking group represented by Formula (5) below, and * is a segment binding to the main chain skeleton of the resin having an acidic functional group;

(5)

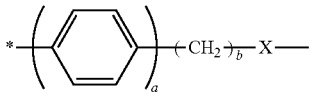

where a is 0 or 1, b is an integer of at least 0 and not more than 4, X is a single bond or a group represented by —O—, —S— or —$NR^{10}$—, $R^{10}$ is a hydrogen atom or $C_{1-4}$ alkyl group, and * is a segment binding to the main chain skeleton of the resin having an acidic functional group.

11. The toner according to claim 1, wherein the resin having an acidic functional group has a structure represented by Formula (6) below:

(6)

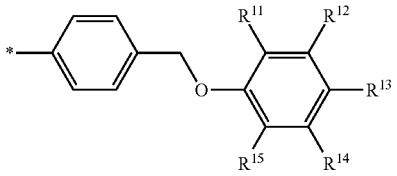

where one of $R^{12}$ and $R^{13}$ is a carboxy group, and the other is a hydroxy group, each of $R^{11}$, $R^{14}$ and $R^{15}$ is independently a hydrogen atom, hydroxyl group, amino group, $C_{1-4}$ alkyl group or $C_{1-4}$ alkoxy group, and * is a segment binding to the main chain skeleton of the resin having an acidic functional group.

12. The toner according to claim 1, wherein the resin having an acidic functional group has a weight-average molecular weight of at least 10,000 and not more than 75,000.

13. The toner according to claim 1, wherein content of the resin having an acidic functional group is at least 3.0 mass parts and not more than 30.0 mass parts per 100 mass parts of the pigment.

14. The toner according to claim 1, wherein content of the resin having an acidic functional group is at least 5.0 mass parts and not more than 40.0 mass parts per 100 mass parts of the fixing auxiliary agent.

15. The toner according to claim 1, wherein a melting point of the fixing auxiliary agent is at least 55° C. and not more than 100° C.

16. The toner according to claim 1, wherein the fixing auxiliary agent is a crystalline polyester.

17. The toner according to claim 16, wherein a weight-average molecular weight of the crystalline polyester is at least 10,000 and not more than 40,000.

18. The toner according to claim 1, wherein the fixing auxiliary agent is at least one of an ester compound of a monohydric or polyhydric alcohol with an aliphatic monocarboxylic acid, and an ester compound of a monovalent or polyvalent carboxylic acid with an aliphatic alcohol.

19. A method for manufacturing a toner, wherein the toner is a toner comprising a toner particle containing a binder resin, a pigment, a resin having an acidic functional group, and a fixing auxiliary agent;

the pigment is a pigment having a structure derived from a basic compound;

the binder resin and the fixing auxiliary agent satisfying following Formula (1)

$$(TgA-TgB)\geq 5.0^\circ\ C. \qquad \text{Formula (1)}$$

where

TgA represents a glass transition temperature (Tg) in differential scanning calorimetry of the binder resin, and TgB represents a Tg in differential scanning calorimetry of a resin mixture obtained by mixing the binder resin and the fixing auxiliary agent at a mass ratio of 9:1; and the resin having an acidic functional group has a hydrophobic parameter HP1 of at least 0.60, the fixing auxiliary agent has a hydrophobic parameter HP2, and the HP1 and the HP2 satisfy following Formula:

$$|HP1-HP2|\leq 0.30 \qquad \text{Formula (2)}$$

where HP1 represents a volume fraction of heptane at a point of precipitation by the resin having an acidic functional group as measured by the addition of heptane to a solution containing 0.01 mass parts of the resin having an acidic functional group and 1.48 mass parts of chloroform, and HP2 represents a volume fraction of heptane at a point of precipitation by the fixing auxiliary agent as measured by the addition of heptane to a solution containing 0.01 mass parts of the fixing auxiliary agent and 1.48 mass parts of chloroform, the method comprising a step (i) or a step (ii) below:

(i) a step of granulating, in an aqueous medium, a polymerizable monomer composition containing a polymerizable monomer capable of forming the binder resin, the resin having an acidic functional group, the pigment, and the fixing auxiliary agent, and then polymerizing the polymerizable monomer contained in the polymerizable monomer composition, to thereby manufacture a toner particle;

(ii) a step of granulating, in an aqueous medium, an organic solvent dispersion containing the binder resin, the pigment, the resin having an acidic functional group and the fixing auxiliary agent in an organic solvent, to thereby manufacture a toner particle.

20. A toner comprising a toner particle containing a binder resin, a pigment, and a resin having an acidic functional group, wherein the toner particle further contains at least one of a crystalline polyester and a wax, the wax is at least one of an ester compound of a monohydric or polyhydric alcohol with an aliphatic monocarboxylic acid and an ester compound of a monovalent or polyvalent carboxylic acid with an aliphatic monoalcohol, the pigment is a pigment having a structure derived from a basic compound, and the resin having an acidic functional group has a hydrophobic parameter HP1 of at least 0.60, the crystalline polyester or wax has a hydrophobic parameter HP2, and the HP1 and the HP2 satisfy following Formula (2):

$$|HP1-HP2| \leq 0.30 \qquad \text{Formula (2)}$$

where HP1 represents a volume fraction of heptane at a point of precipitation by the resin having an acidic functional group as measured by the addition of heptane to a solution containing 0.01 mass parts of the resin having an acidic functional group and 1.48 mass parts of chloroform, and HP2 represents a volume fraction of heptane at a point of precipitation by the crystalline polyester or wax as measured by the addition of heptane to a solution containing 0.01 mass parts of the crystalline polyester or wax and 1.48 mass parts of chloroform.

* * * * *